US009388947B2

(12) United States Patent
Bradford

(10) Patent No.: US 9,388,947 B2
(45) Date of Patent: Jul. 12, 2016

(54) LIGHTING DEVICE INCLUDING SPATIALLY SEGREGATED LUMIPHOR AND REFLECTOR ARRANGEMENT

(75) Inventor: Everett Bradford, Apex, NC (US)

(73) Assignee: Cree, Inc., Durham, NC (US)

( * ) Notice: Subject to any disclaimer, the term of this patent is extended or adjusted under 35 U.S.C. 154(b) by 8 days.

(21) Appl. No.: 13/596,705

(22) Filed: Aug. 28, 2012

(65) Prior Publication Data

US 2014/0063779 A1 Mar. 6, 2014

(51) Int. Cl.

| | |
|---|---|
| ***F21V 9/16*** | (2006.01) |
| ***F21K 99/00*** | (2016.01) |
| ***F21V 23/04*** | (2006.01) |
| *F21V 7/00* | (2006.01) |
| *F21V 7/22* | (2006.01) |
| *F21V 13/12* | (2006.01) |
| *F21Y 101/02* | (2006.01) |
| *F21Y 113/00* | (2016.01) |
| *F21V 3/04* | (2006.01) |
| *F21V 29/505* | (2015.01) |
| *F21V 29/74* | (2015.01) |

(52) U.S. Cl.

CPC ..... *F21K 9/1375* (2013.01); *F21K 9/56* (2013.01); *F21V 23/0442* (2013.01); *F21V 3/0463* (2013.01); *F21V 7/0016* (2013.01); *F21V 7/0033* (2013.01); *F21V 7/22* (2013.01); *F21V 13/12* (2013.01); *F21V 29/505* (2015.01); *F21V 29/74* (2015.01); *F21V 29/745* (2015.01); *F21Y 2101/025* (2013.01); *F21Y 2113/005* (2013.01)

(58) Field of Classification Search

CPC ..... F21K 9/1375; F21K 9/56; F21V 13/12; F21V 23/0442; F21V 29/505; F21V 29/00; F21V 29/002; F21V 29/004; F21V 29/504; F21V 13/00–13/14

USPC ..... 362/84, 294, 296.01, 227, 230, 362/231–233, 235, 249.03, 277, 285, 293, 362/507

See application file for complete search history.

(56) References Cited

U.S. PATENT DOCUMENTS

| | | | | |
|---|---|---|---|---|
| 1,675,731 | A * | 7/1928 | Schofield | F21V 11/00 362/291 |
| 7,070,300 | B2 * | 7/2006 | Harbers et al. | 362/231 |
| 7,095,056 | B2 | 8/2006 | Vitta et al. | |
| 7,178,937 | B2 * | 2/2007 | McDermott | 362/187 |
| 7,234,820 | B2 | 6/2007 | Harbers et al. | |
| 7,293,908 | B2 | 11/2007 | Beeson et al. | |
| 7,505,205 | B2 * | 3/2009 | Sacre et al. | 359/618 |

(Continued)

OTHER PUBLICATIONS

Evans, Scott, "BMW's Laser Headlights—BMW Shows Us How its Freakin' Laser Light Show Works", published online at: http://wot.motortrend.com/bmw-shows-us-how-its-laser-headlights-and-dynamic-lightspot-work-126103.html on Oct. 14, 2011.

*Primary Examiner* — Laura Tso
*Assistant Examiner* — Naomi M Wolford
(74) *Attorney, Agent, or Firm* — Withrow & Terranova, P.L.L.C.; Vincent K. Gustafson

(57) ABSTRACT

A lighting device includes one or more lumiphoric materials spatially segregated from one or more electrically activated (e.g., solid state) emitters and arranged to emit light toward a reflector for reflection of lumiphor-converted light emissions toward a light transmissive end of the lighting device. One or more adjustment elements may be arranged adjust position of the at least one lumiphoric material, and/or to adjust at least one of (a) position, (b) aim, and (c) focus, of the at least one electrically activated light emitting source.

36 Claims, 7 Drawing Sheets

(56) References Cited

U.S. PATENT DOCUMENTS

| | | | | |
|---|---|---|---|---|
| 7,515,343 | B2 * | 4/2009 | Edlinger et al. | 359/629 |
| 7,543,959 | B2 | 6/2009 | Bierhuizen et al. | |
| 7,651,243 | B2 * | 1/2010 | McGuire et al. | 362/293 |
| 7,665,865 | B1 * | 2/2010 | Hulse et al. | 362/277 |
| 7,703,945 | B2 | 4/2010 | Leung et al. | |
| 7,810,956 | B2 * | 10/2010 | Bierhuizen et al. | 362/294 |
| 8,083,364 | B2 | 12/2011 | Allen | |
| 2005/0105301 | A1 * | 5/2005 | Takeda et al. | 362/545 |
| 2006/0171152 | A1 | 8/2006 | Suehiro et al. | |
| 2007/0085103 | A1 | 4/2007 | Nishioka et al. | |
| 2008/0117500 | A1 | 5/2008 | Narendran et al. | |
| 2009/0008573 | A1 | 1/2009 | Conner | |
| 2010/0103678 | A1 | 4/2010 | van de Ven et al. | |
| 2010/0165599 | A1 * | 7/2010 | Allen | 362/84 |
| 2010/0177522 | A1 * | 7/2010 | Lee | 362/373 |
| 2011/0170289 | A1 * | 7/2011 | Allen et al. | 362/235 |
| 2011/0182065 | A1 | 7/2011 | Negley et al. | |
| 2011/0205733 | A1 * | 8/2011 | Lenderink et al. | 362/231 |
| 2011/0215700 | A1 | 9/2011 | Tong et al. | |
| 2011/0280039 | A1 * | 11/2011 | Kishimoto | 362/554 |
| 2013/0070439 | A1 * | 3/2013 | Maxik et al. | 362/84 |

* cited by examiner

LIGHTING DEVICE INCLUDING SPATIALLY SEGREGATED LUMIPHOR AND REFLECTOR ARRANGEMENT

TECHNICAL FIELD

Subject matter herein relates to lighting apparatuses, including specific embodiments directed to systems and methods utilizing one or more electrically activated emitters (including solid state emitters such as lasers and/or light emitting diodes) arranged to stimulate emissions from one or more lumiphoric materials located remotely from the electrically activated emitter(s).

BACKGROUND

Lumiphoric materials are commonly used with electrically activated emitters to produce a variety of emissions such as colored (e.g., non-white) or white light (e.g., perceived as being white or near-white). Such emitters may include any device capable of producing visible or near visible (e.g., from infrared to ultraviolet) wavelength radiation including, but not limited to, xenon lamps, mercury lamps, sodium lamps, incandescent lamps, and solid state emitters—including light emitting diodes (LEDs), organic light emitting diodes (OLEDs), polymer light emitting diodes (PLEDs), light emitting polymers, and lasers. Electrically activated emitters may have associated filters that alter the color of the light and/or include lumiphoric materials that absorb a portion of a first peak wavelength emitted by the emitter and re-emit the light at a second peak wavelength different from the first peak wavelength. Examples of common lumiphoric materials include, but are not limited to, phosphors, scintillators, and lumiphoric inks.

LEDs are solid state electrically activated emitters that convert electric energy to light, and generally include one or more active layers of semiconductor material sandwiched between oppositely doped layers. When bias is applied across doped layers, holes and electrons are injected into one or more active layers, where they recombine to generate light that is emitted from the device. Laser diodes are solid state emitters that operate according to similar principles.

Solid state light sources may be utilized to provide colored (e.g., non-white) or white light (e.g., perceived as being white or near-white). White solid state emitters have been investigated as potential replacements for white incandescent or fluorescent lamps due to reasons including substantially increased efficiency and longevity. Longevity of solid state emitters is of particular benefit in environments where access is difficult and/or where change-out costs are extremely high. A representative example of a white LED lamp includes a package of a blue LED chip (e.g., made of InGaN and/or GaN) combined with a lumiphoric material such as a phosphor (typically YAG:Ce) that absorbs at least a portion of the blue light (first wavelength) and re-emits yellow light (second wavelength), with the combined yellow and blue emissions providing light that is perceived as white or near-white in character. If the combined yellow and blue light is perceived as yellow or green, it can be referred to as 'blue shifted yellow' ("BSY") light or 'blue shifted green' ("BSG") light. Addition of red spectral output from an electrically activated emitter or lumiphoric material may be used to increase the warmth of the aggregated light output. Additional or different supplemental electrically activated emitters and/or lumiphors of different wavelengths may be provided to provide desired spectral response. As an alternative to phosphor-based white LEDs, combined emission of red, blue, and green emitters and/or lumiphoric materials may also be perceived as white or near-white in character. Another approach for producing white light is to stimulate phosphors or dyes of multiple colors with a violet or ultraviolet LED source.

In contrast to sunlight, and also in contrast to standard incandescent and halogen lamps, individual solid state emitters such as LEDs typically emit relatively narrow ranges of wavelengths. For example, each "pure color" red, green, and blue diode typically has a full-width half-maximum (FWHM) wavelength range of from about 15 nm to about 30 nm. Substantial efforts have been undertaken to broaden spectral output of devices including solid state emitters (such as by mixing light from many LEDs having different chromaticities and/or using one or more phosphors) in order to increase efficacy in general illumination applications, and to better emulate spectral power distribution characteristic of an incandescent or halogen emitter. For instance, emissions from a LED/phosphor combination that would otherwise be cool white and deficient in red component (e.g., compared to an incandescent emitter) may be supplemented with red and/or cyan LEDs, such as disclosed by U.S. Pat. No. 7,095,056 (Vitta), to achieve a desired color temperature and provide generally warmer light.

Many modern lighting applications require high power emitters to provide a desired level of brightness. High power emitters can draw large currents, thereby generating significant amounts of heat. Conventional binding media used to deposit lumiphoric materials such as phosphors onto emitter surfaces typically degrade and change (e.g., darken) in color with exposure to intense heat. Degradation of the medium binding a phosphor to an emitter surface shortens the life of the emitter structure. When the binding medium darkens as a result of intense heat, the change in color has the potential to alter its light transmission characteristics, thereby resulting in a non-optimal emission spectrum. Limitations associated with binding a phosphor to an emitter surface generally restrict the total amount of radiance that can be applied to a phosphor. In order to increase reliability and prolong useful service life of a lighting device including a lumiphoric material, the lumiphoric material may be physically separated from an electrically activated emitter.

U.S. Pat. No. 7,070,300 to Harbers et al. discloses various arrangements of phosphor layers that are physically separated from one or more electrically activated light sources, permitting the light source(s) to be driven with increased current to produce higher radiance without thermal degradation of the phosphor layers. In each instance, Harbers discloses transmission of light though phosphor layers (for wavelength conversion) before the resulting emissions exit the device. The requirement that all emissions be transmitted through phosphor layers in a device according to Harbers limits the concentration and/or amount of phosphor material that may be used, however, since an excessive concentration and/or amount of phosphor material would unduly attenuate or even block light emissions from exiting the device. It would be desirable to enable greater concentrations and/or amounts of phosphor materials to be used in lighting devices without unduly attenuating or blocking emissions from exiting a lighting device.

U.S. Patent Application Publication No. 2010/0103678 to van de Ven, et al. discloses a lighting device that includes at least one centrally located, rear-facing electrically activated solid state emitter (optionally including one or more lumiphoric materials arranged thereon) arranged to emit light toward a reflector that reflects light forward for transmission past (e.g., around) the solid state emitter(s) to exit the lighting device in a forward direction. The electrically activated emitter(s) are arranged in thermal communication with a heat pipe that conducts heat from the electrically activated emitter(s) to a heatsink arranged along a lateral periphery of the lighting device to provide adequate heat dissipation. Although providing rear-facing electrically activated solid state emitters remotely located from a reflector provides favorable optical characteristics (e.g., reduced glare and/or controlled beam angle), devices according to van de Ven are expensive to manufacture due to the necessary inclusion of a heat pipe, and further exhibit various limitations associated with placing lumiphoric materials in conductive thermal communication with electrically activated emitters (as outlined hereinabove). It would be desirable to provide lighting devices with favorable optical and heat transfer characteristics, while eliminating the need for heatpipes and permitting the use of remote lumiphoric materials.

It would be desirable to provide lighting devices including lumiphor-converted emissions and capable of operating at high luminous flux, including emissions with high color rendering index and color quality scale characteristics. It would further be desirable to provide lighting devices with readily adjustable output color and/or chromaticity. It would also be desirable to provide lighting devices with adjustable focus, adjustable beam pattern, and/or adjustable color mixing characteristics.

Various embodiments as disclosed herein address or more of the foregoing concerns.

SUMMARY

The present invention relates in various aspects to lighting devices including one or more lumiphoric materials spatially segregated from one or more electrically activated emitters and arranged to emit light toward a reflector for reflection of lumiphor-converted light emissions toward a light transmissive end of a lighting device.

In one aspect, a lighting device comprises: a light-transmissive end; at least one solid state light emitting source; a reflector comprising a cup-shaped body including (i) a reflective surface, (ii) at least one aperture arranged to receive the at least one solid state light emitting source or arranged to enable transmission of light emissions of the at least one solid state light emitting source through the at least one aperture, and (iii) a light-transmissive opening arranged to permit transmission of light reflected by the reflector toward the light-transmissive end; and at least one lumiphoric material that is spatially segregated from the at least one solid state light emitting source, that is arranged to receive at least a portion of the emissions of the at least one solid state light emitting source, and that is arranged to emit lumiphor-converted light emissions toward the reflector; wherein the reflector is arranged to reflect lumiphor-converted light emissions toward the light-transmissive end.

In another aspect, a lighting device comprises: a light-transmissive end; at least one solid state light emitting source; a reflector comprising a cup-shaped body including a reflective surface and a light-transmissive opening arranged to permit transmission of light reflected by the reflector toward the light-transmissive end; and at least one lumiphoric material that is (i) spatially segregated from the first and the second solid state light emitting source, (ii) arranged on or over a reflective support surface, (iii) arranged to receive at least a portion of the emissions of the at least one solid state light emitting source, and (iv) arranged to emit lumiphor-converted light emissions toward the reflector; wherein the reflector is arranged to reflect lumiphor-converted light emissions toward the light-transmissive end; and wherein the lighting device comprises at least one of the following features (a) and (b): (a) the at least one solid state light emitting source comprises a first solid state light emitting source adapted to generate emissions including a first peak wavelength and comprises a second solid state light emitting source comprising a second solid state light emitting source adapted to generate emissions including a second peak wavelength, wherein the first peak wavelength differs from the second peak wavelength by at least 30 nm; and (b) the at least one lumiphoric material comprises a first lumiphoric material adapted to generate emissions including a third peak wavelength and comprises a second lumiphoric material adapted to generate emissions including a fourth peak wavelength, wherein the third peak wavelength differs from the fourth peak wavelength by at least 30 nm.

In another aspect, a lighting device comprises: a light-transmissive end; at least one solid state light emitting source; a reflector comprising a cup-shaped body including a reflective surface and a light-transmissive opening arranged to permit transmission of light reflected by the reflector toward the light-transmissive end; at least one lumiphoric material that is (i) spatially segregated from the first and the second solid state light emitting source, (ii) arranged on or over at least one lumiphor support surface, (iii) arranged to receive at least a portion of the emissions of the at least one solid state light emitting source, and (iv) adapted to emit lumiphor-converted light emissions toward the reflector; and at least one of (a) an adjustment element arranged to adjust at least one of chromaticity and color temperature of aggregated light emissions of the lighting device, and (b) a heatsink in conductive thermal communication with the at least one lumiphoric material and arranged to dissipate heat from the at least one lumiphoric material to an ambient air environment; wherein the reflector is arranged to reflect lumiphor-converted light emissions toward the light-transmissive end.

In another aspect, the invention relates to a method utilizing a lighting device comprising a light-transmissive end, at least one solid state light emitting source, a reflector comprising a cup-shaped body including a reflective surface and a light-transmissive opening arranged to permit transmission of light reflected by the reflector toward the light-transmissive end; and at least one lumiphoric material that is (i) spatially segregated from the first and the second solid state light emitting source, (ii) arranged on or over at least one lumiphor support surface, (iii) arranged to receive at least a portion of the emissions of the at least one solid state light emitting source, and (iv) adapted to emit lumiphor-converted light emissions toward the reflector, the method comprising: operating a mechanical adjustment element to adjust interaction between the at least one solid state light emitting source and the at least one lumiphoric material to thereby adjust at least one of color, chromaticity, beam pattern, and color mixing of emissions transmitted by the lighting device through the light-transmissive end.

Further aspects relating to methods of illuminating an object, a space, or an environment utilizing at least one lighting device as disclosed herein.

In another aspect, any of the foregoing aspects, and/or various separate aspects and features as described herein, may be combined for additional advantage.

Other aspects, features and embodiments of the invention will be more fully apparent from the ensuing disclosure and appended claims.

BRIEF DESCRIPTION OF THE DRAWINGS

FIG. 10 is a side cross-sectional view of a portion of a lighting device according to one embodiment including at least one electrically activated light emitter and optional beam adjustment and/or optical elements received by an aperture defined in a reflector, as useful to stimulate at least one lumiphoric material arranged remotely from the at least one electrically activated light emitter.

DETAILED DESCRIPTION

Figure 1A:
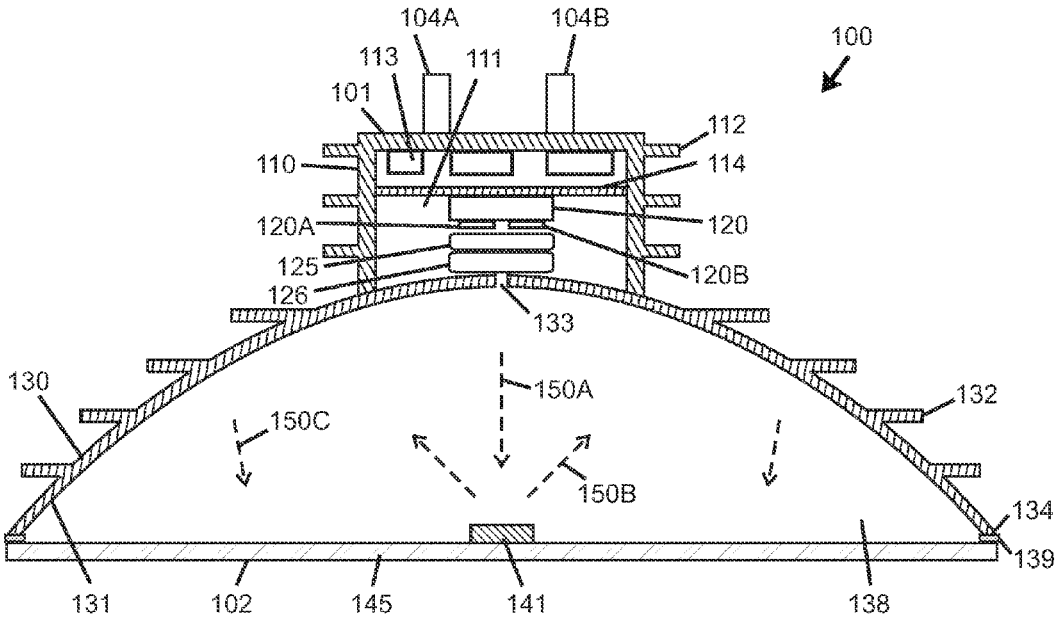
FIG. 1A is a side cross-sectional schematic view of a lighting device according to one embodiment including multiple electrically activated light emitters arranged to transmit light through an aperture defined in a cup-shaped reflector to impinge on at least one lumiphoric material supported by a lens arranged to enclose a cavity of the reflector, with the at least one lumiphoric material arranged to emit light rearward toward the reflector for reflection of light toward a light-emitting end of the lighting device.

Subject matter herein relates to electrically activated (e.g., solid state) lighting devices, including devices including one or more lumiphoric materials spatially segregated from one or more electrically activated emitters and arranged to emit light toward a reflector for reflection of lumiphor-converted light emissions toward a light transmissive end of a lighting device. Various properties of beams generated by one or more electrically activated emitters, and/or relative position between one or more lumiphoric materials and one or more electrically activated emitters, may be adjusted by various means to adjust one or more properties of emissions from the lighting device.

Unless otherwise defined, terms used herein should be construed to have the same meaning as commonly understood by one of ordinary skill in the art to which this invention belongs. It will be further understood that terms used herein should be interpreted as having a meaning that is consistent with their meaning in the context of this specification and the relevant art, and should not be interpreted in an idealized or overly formal sense unless expressly so defined herein.

Embodiments of the invention are described herein with reference to cross-sectional, perspective, and/or plan view illustrations that are schematic illustrations of idealized embodiments of the invention. Variations from the shapes of the illustrations as a result, for example, of manufacturing techniques and/or tolerances, are to be expected, such that embodiments of the invention should not be construed as limited to particular shapes illustrated herein. This invention may be embodied in different forms and should not be construed as limited to the specific embodiments set forth herein. In the drawings, the size and relative sizes of layers and regions may be exaggerated for clarity.

Unless the absence of one or more elements is specifically recited, the terms "comprising," "including," and "having" as used herein should be interpreted as open-ended terms that do not preclude the presence of one or more elements.

It will be understood that when an element such as a layer, region, or substrate is referred to as being "on" another element, it can be directly on the other element or intervening elements may be present. Moreover, relative terms such as "forward," "rearward," and the like may be used herein to describe relationships of various components and/or beams as illustrated in the figures. It will be understood that these terms are intended to encompass different orientations of the device in addition to the orientation depicted in the figures.

The terms "electrically activated emitter" and "emitter" as used herein refers to any device capable of producing visible or near visible (e.g., from infrared to ultraviolet) wavelength radiation, including but not limited to, xenon lamps, mercury lamps, sodium lamps, incandescent lamps, and solid state emitters, including diodes (LEDs), organic light emitting diodes (OLEDs), and lasers.

The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials.

Solid state light emitting devices according to embodiments of the invention may include III-V nitride (e.g., gallium nitride) based LEDs or lasers fabricated on a silicon carbide, sapphire, or III-V nitride substrate, including (for example) devices manufactured and sold by Cree, Inc. of Durham, N.C. Such LEDs and/or lasers may be configured to operate such that light emission occurs through the substrate in a so-called "flip chip" orientation. Such LEDs and/or lasers may also be devoid of substrates (e.g., following substrate removal).

Electrically activated light emitters (including solid state light emitters) may be used individually or in groups to emit one or more beams to stimulate emissions of one or more lumiphoric materials (e.g., phosphors, scintillators, lumiphoric inks, quantum dots) to generate light at one or more peak wavelength, or of at least one desired perceived color (including combinations of colors that may be perceived as white). Inclusion of lumiphoric (also called 'luminescent') materials in lighting devices as described herein may be accomplished by direct coating on lumiphor support elements or lumiphor support surfaces (e.g., by powder coating, inkjet printing, or the like), adding such materials to lenses, and/or by embedding or dispersing such materials within lumiphor support elements or surfaces. Other materials, such as light scattering elements (e.g., particles) and/or index matching materials, may be associated with a lumiphoric material-containing element or surface. Lumiphor support elements as disclosed herein may include lenses, reflectors, substrates, and the like, with such lumiphor support elements in preferred embodiments including reflective materials to promote reflection of a lumiphor converted beam (or portions of an unabsorbed incident beam generated by at least one electrically activated emitter) toward a cavity-defining reflector of a lighting device as disclosed herein.

The expression "peak wavelength", as used herein, means (1) in the case of a solid state light emitter, to the peak wavelength of light that the solid state light emitter emits if it is illuminated, and (2) in the case of a lumiphoric material, the peak wavelength of light that the lumiphoric material emits if it is excited.

A wide variety of wavelength conversion materials (e.g., luminescent materials, also known as lumiphors or luminophoric media, e.g., as disclosed in U.S. Pat. No. 6,600,175 and U.S. Patent Application Publication No. 2009/0184616), are well-known and available to persons of skill in the art. Examples of luminescent materials (lumiphors) include phosphors, scintillators, day glow tapes, nanophosphors, quantum dots (e.g., such as provided by NNCrystal US Corp. (Fayetteville, Ark.)), and inks that glow in the visible spectrum upon illumination with (e.g., ultraviolet) light. One or more luminescent materials useable in devices as described herein may be down-converting or up-converting, or can include a combination of both types.

Various embodiments include electrically activated emitters and lumiphoric materials that are spatially segregated (i.e., remotely located) from one or more electrically activated emitters. In certain embodiments, such spatial segregation may involve separation of a distance of at least about 1 cm, at least about 2 cm, at least about 5 cm, or at least about 10 cm.

Some embodiments of the present invention may use solid state emitters, emitter packages, fixtures, luminescent materials/elements, power supplies, control elements, and/or methods such as described in U.S. Pat. Nos. 7,564,180; 7,456,499; 7,213,940; 7,095,056; 6,958,497; 6,853,010; 6,791,119; 6,600,175, 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862, and/or 4,918,497, and U.S. Patent Application Publication Nos. 2009/0184616; 2009/0080185; 2009/0050908; 2009/0050907; 2008/0308825; 2008/0198112; 2008/0179611, 2008/0173884, 2008/0121921; 2008/0012036; 2007/0253209; 2007/0223219; 2007/0170447; 2007/0158668; 2007/0139923, and/or 2006/0221272; with the disclosures of the foregoing patents and published patent applications being hereby incorporated by reference as if set forth fully herein.

The expression "lighting device", as used herein, is not limited, except that it is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or backlighting (e.g., backlight poster, signage, LCD displays), light bulbs, bulb replacements (e.g., for replacing AC incandescent lights, low voltage lights, fluorescent lights, etc.), outdoor lighting, security lighting, exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting-work lights, etc., mirrors/vanity lighting, or any other light emitting device. In certain embodiments, lighting devices as disclosed herein are self-ballasted.

The inventive subject matter further relates in certain embodiments to an illuminated enclosure (the volume of which can be illuminated uniformly or non-uniformly), comprising an enclosed space and at least one lighting device as disclosed herein, wherein the lighting device illuminates at least a portion of the enclosure (uniformly or non-uniformly). The inventive subject matter further relates to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, a LCD display, a cave, a tunnel, a yard, a lamppost, etc., having mounted therein or thereon at least one lighting device as described herein. Methods include illuminating an object, a space, or an environment, utilizing one or more lighting devices as disclosed herein.

In certain embodiments, lighting devices as described herein including at least one electrically activated (e.g., solid state) emitter with a peak wavelength in the visible range. In certain embodiments, multiple electrically activated (e.g., solid state) emitters are provided, with such emitters optionally being independently controllable. In certain embodiments, lighting devices as described herein include a first LED comprising a first LED peak wavelength, and comprises a second LED comprising a second LED peak wavelength that differs from the first LED peak wavelength by at least 20 nm, or by at least 30 nm. In such a case, each of the first wavelength and the second wavelength is preferably within the visible range.

Certain embodiments of the present invention may involve use of solid state emitter packages. A solid state emitter package typically includes at least one solid state emitter chip that is enclosed with packaging elements to provide environmental and/or mechanical protection, color selection, and light focusing, as well as electrical leads, contacts, and/or traces enabling electrical connection to an external circuit. Encapsulant materials, optionally including lumiphoric material, may be disposed over solid state emitters, lumiphoric materials, and/or lumiphor-containing layers in a solid state emitter package. Multiple solid state emitters may be provided in a single package. A package including multiple solid state emitters may include at least one of the following features: a single leadframe arranged to conduct power to the solid state emitters, a single reflector (e.g., a reflector cup) arranged to reflect at least a portion of light emanating from each solid state emitter, a single submount supporting each solid state emitter, and a single lens arranged to transmit at least a portion of light emanating from each solid state emitter.

Individual emitters in a solid state emitter package, or groups of emitters (e.g., wired in series) in a solid state emitter package, may be separately controlled. Multiple solid state emitter packages may be arranged in a single solid state lighting device. Individual solid state emitter packages or groups of solid state emitter packages (e.g., wired in series) may be separately controlled. Separate control of individual emitters, groups of emitters, individual packages, or groups of packages, may be provided by independently applying drive currents to the relevant components with control elements known to those skilled in the art. In one embodiment, at least one control circuit a may include a current supply circuit configured to independently apply an on-state drive current to each individual solid state emitter, group of solid state emitters, individual solid state emitter package, or group of solid state emitter packages. Such control may be responsive to a control signal (optionally including at least one sensor arranged to sense electrical, optical, and/or thermal properties and/or environmental conditions), and a control system may be configured to selectively provide one or more control signals to the at least one current supply circuit. In various embodiments, current to different circuits or circuit portions may be pre-set, user-defined, or responsive to one or more inputs or other control parameters.

Certain embodiments of the present invention further relate to the use of light fixtures include multiple electrically activated (e.g., solid state) emitters as disclosed herein. Multiple emitters may be arranged on a single substrate and/or mounting plate, whether individually or as part of multi-chip packages or other multi-chip lamps. Any desirable number of electrically activated emitters may be incorporated into a light fixture. Each electrically activated emitter or emitter-containing package in a single fixture may be substantially identical to one another, or emitters (or emitter-containing packages) with different output characteristics may be intentionally provided in a single light fixture. A light fixture may include one or more control circuits arranged in electrical communication with electrically activated emitters and/or emitter packages contained in or supported by the fixture.

In certain embodiments, a lighting device may include a light-transmissive end; at least one solid state light emitting source; a reflector comprising a cup-shaped body including (i) a reflective surface, (ii) at least one aperture arranged to receive the at least one solid state light emitting source or arranged to enable transmission of light emissions of the at least one solid state light emitting source through the at least one aperture, and (iii) a light-transmissive opening arranged to permit transmission of light reflected by the reflector toward the light-transmissive end; and at least one lumiphoric material that is spatially segregated from the at least one solid state light emitting source, that is arranged to receive at least a portion of the emissions of the at least one solid state light emitting source, and that is arranged to emit lumiphor-converted light emissions toward the reflector; wherein the reflector is arranged to reflect lumiphor-converted light emissions toward the light-transmissive end.

A reflector of a lighting device as disclosed herein can be of any desired shape, and in many embodiments, the reflector may be shaped so as to allow a high percentage of light directed toward the reflector) to exit from the lighting device. A wide variety of shapes for a reflector in a lighting device, or for a combination of plural reflectors in a lighting device, are well known, and any such reflectors or combinations of reflectors can be employed in the lighting devices according to the present inventive subject matter. Multiple reflector elements may be used. The reflector(s) can be shaped and oriented relative to the one or more light sources such that some or all of the light from the light source will reflect once before exiting the lighting device, will reflect twice before exiting the lighting device (i.e., once off a first reflector and once off a second reflector, or twice of the same reflector), or will reflect any other number of times before exiting the light device. This includes situations where some light from a light source reflects a first number of times (e.g., only once) before exiting the lighting device and other light from the light source reflects a second number of times (e.g., twice) before exiting the lighting device (and situations where any number of different parts of light from the light source is reflected different numbers of times).

The ability of a reflector to reflect light can be imparted in any desired way, a variety of which are well known to persons of skill in the art. For example, a reflector can comprise one or more material that is reflective (and/or specular, the term "reflective" being used herein to refer to reflective and optionally also specular), and/or that can be treated (e.g., polished) so as to be reflective, or can comprise one or more material that is non-reflective or only partially reflective and which is coated with, laminated to and/or otherwise attached to a reflective material. Persons of skill in the art are familiar with a variety of materials that are reflective, e.g., metals such as aluminum, silver, and glass, to name a few). Reflective coatings may be formed on low-reflective or non-reflective materials.

A reflector may include cusps and/or facets, as known in the art. In some embodiments, the reflector has an M-shaped contour, as also known in the art. In some embodiments, the reflector collects the light emanating from at least one lumiphoric material and/or at least one electrically activated emitter and reflects the light so that a major portion does not it does not strike the light emitter(s) and/or related support structures. In certain embodiments, a reflector may be contoured with the cusps or facets shaped to fill in areas of a beam that would otherwise be light deficient. Cusps or facets may be individually aimed so that light reflected from the reflector(s) forms a desired beam pattern while avoiding undesired (e.g., internal) portions of the lighting device.

In certain embodiments, at least one lumiphoric material is arranged on or over a reflective support surface, a portion of the emissions of the at least one solid state light emitting source are absorbed by the at least one lumiphoric material, and a portion of the emissions of the at least one solid state light emitting source are reflected by the reflective support surface toward the reflector. The reflective support surface may comprise any suitable shape, with at least portions thereof including concave and/or convex shapes (e.g., including but not limited to hemispherical, bullet-shaped, rounded conical, inverted shapes, mixed shapes, and other configurations).

In certain embodiments, a lens is arranged proximate to a light-transmissive opening of a reflector, wherein the at least one lumiphoric material, or a lumiphor support surface arranged to support the at least one lumiphoric material, is supported by the lens. A portion of the lens itself may constitute a lumiphor support surface or lumiphor support element, or a lumiphor support surface or lumiphor support element may be distinct from a lens. In certain embodiments, a lens is arranged proximate to the light-transmissive opening of a reflector, and a support structure distinct from lens is arranged to support the lumiphor between the lens and the at least one aperture. Such a support structure may include spokes or other structures extending from the reflector and/or the lens into a cavity formed by the reflector (e.g., a cavity arranged between the reflector and lens).

In certain embodiments, at least one electrically activated light emitting source comprises a first solid state light emitting source adapted to generate emissions including a first peak wavelength, and comprises a second solid state light emitting source comprising a second solid state light emitting source adapted to generate emissions including a second peak wavelength, and wherein the first peak wavelength differs from the second peak wavelength by at least 30 nm. Any suitable number of two, three, four, five, six, seven, eight, nine, ten, or more electrically activated light emitters (e.g., including but not limited to solid state emitters) may be provided, whether of the same or different peak wavelengths. Such electrically activated light emitters are preferably independently controllable. Outputs of two or more electrically activated (e.g., solid state) light emitters may be combined into a single beam using one or more beam combining elements (such as may include at least one of a dichroic mirror, prism, a diffraction grating, a volume Bragg grating or the like).

In certain embodiments, multiple electrically activated light emitters are provided (e.g., such as may embody the same or different peak wavelengths), wherein a first aperture defined in the reflector is arranged to receive the first solid state light emitting source or arranged to enable transmission of light emissions of the first solid state light emitting source through the first aperture, and wherein a second aperture defined in the reflector is arranged to receive the second solid state light emitting source or arranged to enable transmission of light emissions of the second solid state light emitting source through the second aperture.

In certain embodiments, at least one lumiphoric material is arranged over at least one lumiphor support element, and the at least one lumiphoric material including at least one of a pattern, composition, amount, and concentration that varies according to lateral position on the at least one lumiphor support element.

In certain embodiments, at least one lumiphoric material comprises a first lumiphoric material adapted to generate emissions including a third peak wavelength, and comprises a second lumiphoric material adapted to generate emissions including a fourth peak wavelength, and wherein the third peak wavelength differs from the fourth peak wavelength by at least 30 nm.

In certain embodiments (including embodiments where multiple solid state emitters and/or multiple lumiphoric materials are use), combined emissions of a lighting device embody at least one of (a) a color rendering index (CRI Ra) value of at least 85 over a correlative color temperature (CCT) range of from 5000K to 3000K, and (b) a color quality scale (CQS) value of at least 85 over a correlative color temperature (CCT) range of from 5000K to 3000K.

In certain embodiments, an adjustment element (e.g., including, but not limited to) a mechanical or electromechanical element) may be arranged to adjust position (e.g., rotational and/or translational position) of at least one lumiphoric material. In certain embodiments, distance between at least one lumiphoric material and at least one electrically activated emitter may be varied with an adjustment element, which may include a screw or other mechanical positional adjustment element. In certain embodiments, an adjustment element is manually adjustable. In certain embodiments, an adjustment element is operated with an actuator responsive to an electric signal.

In certain embodiments, an adjustment element is arranged to adjust at least one of (a) position, (b) aim, and (c) focus, of at least one electrically activated light emitting source. Position and/or aiming of electrically activated emitters may be adjusted by affecting position of the emitter support elements, such as by using set screws, one or more actuators, or thermally responsive shape memory alloys for formation of emitter support elements or portions thereof. Whether or not position of electrically activated emitters is altered, beam adjustment and/or optical elements may be used to adjust various properties of beams generated by the electrically activated emitters (including, but not limited to, directionality, focus, beam pattern, color mixing, collimation, etc.). The foregoing adjustment means may be devoid of or distinct from adjustment of source power (e.g., source current) to different electrically activated emitters. In certain embodiments, intensity, color, and/or chromaticity may also be adjusted by adjusting (e.g., separately adjusting) supply of power to the electrically activated emitters.

In certain embodiments, at least one sensor (e.g., photodiodes or other types of light sensors) arranged to sense at least one of color, chromaticity, and intensity of lumiphor-converted light emissions, and at least one electrically activated emitter may be controllable responsive to at least one output signal of the at least one sensor. At least one sensor may be arranged in, on, or proximate to a reflector or a lens of a lighting device as disclosed herein.

In certain embodiments, a heatsink may be arranged in conductive thermal communication with at least one lumiphoric material and arranged to dissipate heat from the at least one lumiphoric material to an ambient air environment. In certain embodiments, such a heatsink may optionally double as an adjustment element to adjust position of at least one lumiphoric material, and optionally may comprise an externally accessible element (e.g., knob) subject to manual manipulation by a user.

In certain embodiments, an adjustment element may be associated with an externally accessible bezel of a lighting device, such that movement of the bezel may be effected to alter position (e.g., translational and/or rotational) position of at least one lumiphoric material arranged to receive emissions from at least one electrically activated emitter of a lighting device.

In certain embodiments, a lens and/or lumiphoric material of a lighting device as disclosed herein may be adapted for removal and replacement. Removal and replacement of lens may be useful to adjust focus, collimation, directionality, color mixing, filtering, beam pattern, diffusion, and/or other output characteristics of a lighting device. Removal and replacement of at least one lumiphoric material may similarly be useful to adjust color, color temperature, beam pattern, and/or other output characteristics. In certain embodiments, an externally accessible bezel of a lighting device may be fastened to a reflector portion or other body structure via a threaded, slotted, manually removable connection type, or tool-aided removable connection type (optionally including one or more removable and replaceable fasteners) to permit a lens and/or lumiphoric material retained by the bezel to be easily removed and replaced. Other removable methods of fastening a lens and/or lumiphoric material to a lighting device may be employed. In certain embodiments, a lumiphoric material may be removed from a lighting device without requiring removal of a lens. In certain embodiments, a lumiphoric material may be arranged along an external surface of a lens, and adhered or otherwise fastened to or against the lens.

In certain embodiments, a method utilizing a lighting device as disclosed herein includes operating a mechanical adjustment element to adjust interaction between at least one solid state light emitting source and at least one lumiphoric material to adjust at least one of color, chromaticity, beam pattern, and color mixing of emissions transmitted by the lighting device through the light-transmissive end of the lighting device.

Certain embodiments as disclosed include methods of using lighting devices as disclosed herein to illuminate an object, a space, or an environment.

Reference will be now be made to the accompanying Figures, which provide exemplary structures to aid in understanding the invention.

Figure 1B:
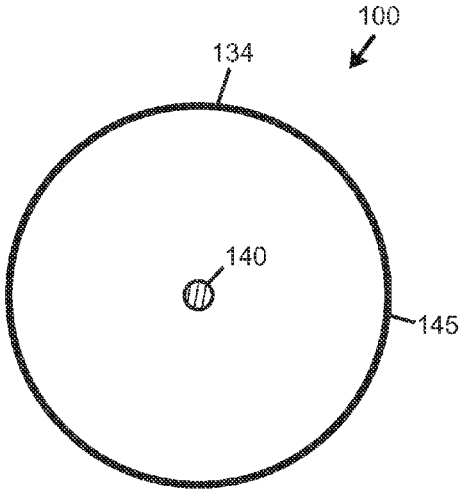
FIG. 1B is a front elevation view of the lighting device of FIG. 1A.
Figure 1C:
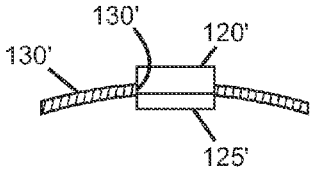

FIGS. 1A-1B illustrate a lighting device 100 according to one embodiment including multiple electrically activated light emitters 120A-120B arranged to transmit light through an aperture 133 defined in a cup-shaped reflector 130 to impinge on at least one lumiphoric material 141 supported by a lens 102 arranged to enclose a cavity 138 of the reflector 130. The lighting device 100 includes a base end 101 with electrical contacts 104A-104B, and a light-emitting end 102 opposite the base end 101, with a tubular body portion 110 proximate to the base end 101. The tubular body portion 110 includes an interior 111 containing power conditioning and/or control components 113, an emitter support element 114, an emitter package 120 including light emitting elements 120A-120B, one or more optional beam adjustment elements 125, and one or more optical elements 126. As shown in FIG. 1A, the width of the reflector 130 is greater than the width of the body portion 110 containing the light emitting elements 120A-120B, and the width of the interior 111 of the body portion 110 is greater than the width of the aperture 133 defined in the reflector 130. Although FIG. 1A illustrates multiple electrically activated light emitting elements 120A-120B as being associated with an emitter package 120 (e.g., a multi-LED package), it is to be appreciated that any suitable number of one or more electrically activated light emitters may be provided, whether as discrete components or combined in one or more packages. The electrically activated emitters 120A-120B may be arranged to emit substantially the same peak wavelength or different peak wavelengths. In certain embodiments, each electrically activated light emitter 120A-120B is separately controllable. While solid state light emitting devices (e.g., lasers and/or LEDs) may be provided in preferred embodiments, any suitable type of electrically activated light emitting devices may be used separately or together in embodiments of the invention. The emitter support element 114 is preferably arranged to conduct heat to the tubular body portion, which optionally includes fins 112 for dissipation of heat (e.g., from the emitters 104A-104B) to an ambient environment (e.g., ambient air). The reflector element 130 includes a reflective inner surface 131, an aperture 133 proximate to the tubular body portion 110, a rim 134 proximate to the light-emitting end 102, and optional fins 132 to promote dissipation of heat. Although the fins 112, 132 are illustrated in FIG. 1A as being substantially parallel to the lens 141, it is to be appreciated that fins may be arranged in any suitable orientation including perpendicular to the lens 145. A lens 145 is arranged to support the at least one lumiphor 141 and is arranged to enclose the cavity 138 defined by the reflector 130. The reflector element 130 and the lens 145 may be joined with an intermediate element 139 that may include a thermally insulating material and/or an adhesive. The at least one lumiphoric material 141 may include one or more lumiphoric materials which may be arranged uniformly or non-uniformly on the lens 145 or an intermediately arranged lumiphor support element (not shown). A reflective material is preferably provided between the at least one lumiphoric material 141 and the lens 145 to ensure reflection of electrically activated emitter emissions (i.e., beam 150A) toward the reflector 130.

In operation of the lighting device 100, electrical power is supplied to the contacts 104A-104B and is optionally conditioned and/or controlled by the power conditioning and/or control components 103 (which may optionally include a ballast, with the device 100 constituting self-ballasted lighting device 100). The electrically activated light emitting elements 120A-120B are energized to emit one or more light beams. Various properties of the one or more light beams (including, but not limited to, directionality, focus, beam pattern, color mixing, and the like) may be adjusted using the at least one beam adjustment element 125 and/or the at least one optical element 126. Intensity, color, and/or chromaticity may also be adjusted by adjusting (e.g., separately adjusting) supply of power to the electrically activated emitters 120A-120B. Although the at least one beam adjustment element 125 is illustrated in FIG. 1A as being optically downstream of the electrically activated emitters 120A-120B, in certain embodiments, at least one beam adjustment element 125 may be intermediately arranged between the emitter support element 114 and the electrically activated emitters 120A-120B (or package 120) to adjust position or directional aiming of the electrically activated emitters 120A-120B. One or more optical elements 126 may be used in addition to, or instead of, one or more beam adjustment elements 126, to adjust one or more properties (e.g., focus, collimation, beam pattern, etc.) of emissions of the electrically activated emitters 120A-120B. Emissions emanating from the electrically activated emitters 120A-120B are directed through the aperture 133 as beam 150A to impinge on the at least one lumiphoric material 141. Part or all of the beam 150A may be absorbed by the at least one lumiphoric material 141 and re-emitted as a lumiphor-converted (wavelength converted) beam 150B—optionally including a portion of the beam 150A that is reflected rearward by the at least one lumiphoric material 141 or an associated reflective substrate (not shown)—emitted toward the reflective inner surface 131 of the reflector element 130. The lumiphor-converted beam 150B is reflected (e.g., in a forward direction) by the reflective inner surface 131 to form a reflected beam 150C that is transmitted toward the light-transmissive end 102, where such beam 150C is transmitted past the at least one lumiphoric material 141 and through the lens 145 to exit the lighting device 100. The lens 145 may optionally include or have associated therewith a diffuser, collimator, and/or other optical elements to affect color mixing and/or beam pattern output by the lighting device 100.

Although FIG. 1A illustrates the electrically activated emitters 120A-120B and any optional behind the reflector element 130 for transmission of light through an aperture 133 defined in the reflector element 130, it is to be appreciated that in certain embodiments at least one electrically activated emitter and/or any (optional) associated beam adjustment and/or optical elements may be received by an aperture defined by a reflector. In this regard, a portion of at least one electrically activated emitter and/or any (optional) associated beam adjustment and/or optical elements may be substantially flush with a surface of the reflector element or extend into a reflector cavity. For example, FIG. 10 is a side cross-sectional view of a portion of a lighting device according to one embodiment including at least one electrically activated light emitter 120' and optional beam adjustment and/or optical elements 125' received by an aperture 133' defined in a reflector 130'. Such arrangement of the at least one electrically activated light emitter 120' and optional beam adjustment and/or optical elements 125' may be used to transmit light to at least one lumiphoric material (not shown) remotely located from the at least one electrically activated light emitter, according to arrangements as disclosed herein.

Figure 2A:
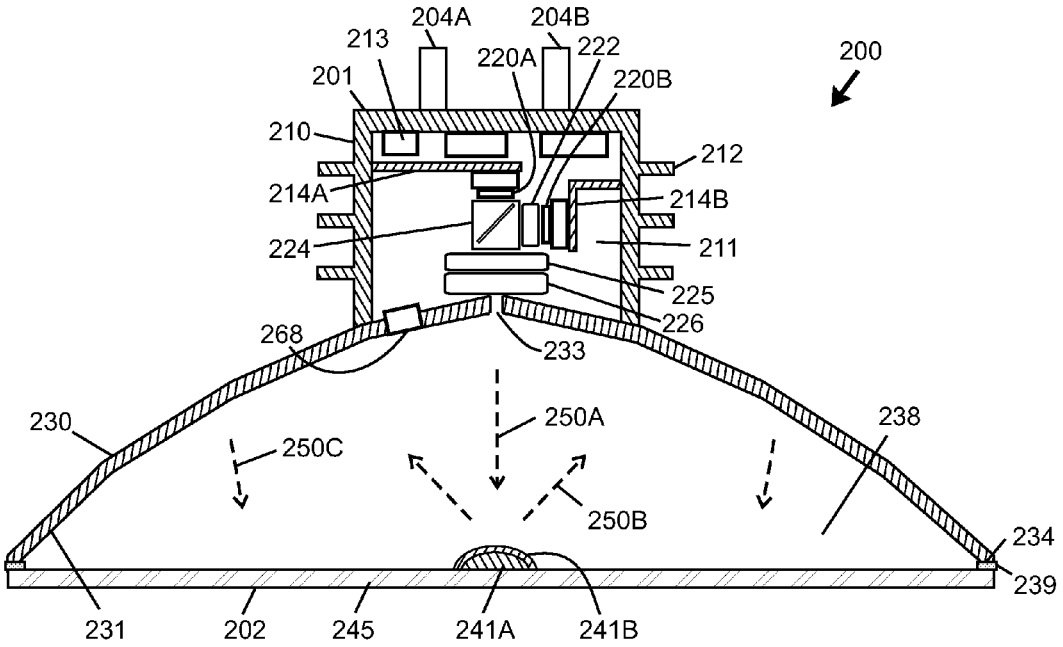
FIG. 2A is a side cross-sectional schematic view of a lighting device according to one embodiment including two electrically activated light emitters and a beam combining element arranged to transmit light through an aperture defined in a cup-shaped reflector to impinge on at least one lumiphoric material supported by a lens that encloses a cavity of the reflector, with the at least one lumiphoric material arranged to emit light rearward toward the reflector for reflection of light toward a light-emitting end of the lighting device.

FIG. 2A illustrates a lighting device 200 according to one embodiment including multiple electrically activated light emitters 220A-220B with emissions subject to being combined using a beam combining element 224 and arranged to transmit light through an aperture 233 defined in a cup-shaped reflector 230 to impinge on at least one (e.g., hemispherical shaped) lumiphoric material 241B supported by a lumiphor support element 241A and a lens 202 arranged to enclose a cavity 238 of the reflector 230. The lighting device 200 includes a base end 201 with electrical contacts 204A-204B, and a light-emitting end 202 opposite the base end 201, with a tubular body portion 210 proximate to the base end 201. The tubular body portion 210 includes an interior 211 containing power conditioning and/or control components 213 (e.g., optionally including a ballast with the device 200 comprising a self-ballasted lamp), emitter support element 214A-214B arranged to support electrically activated light emitting elements 220A-220B, and optional beam adjustment and/or optical elements 222, 224, 225. As shown in FIG. 2A, the width of the reflector 230 is greater than the width of the body portion 210 containing the light emitting elements 220A-220B, and the width of the body portion 210 is greater than the width of the aperture 233 defined in the reflector 230. Although FIG. 2A illustrates discrete electrically activated light emitting elements 220A-220B, it is to be appreciated that one or more of such elements 220A-220B may include multiple emitters (e.g., optionally combinable in emitter packages). The electrically activated emitters 220A-220B may be arranged to emit substantially the same peak wavelength or different peak wavelengths. In certain embodiments, each electrically activated light emitter 220A-220B is separately controllable. While solid state light emitting devices (e.g., lasers and/or LEDs) may be provided in preferred embodiments, any suitable type of electrically activated light emitting devices may be used separately or together in embodiments of the invention. The emitter support elements 214A-214B are preferably arranged to conduct heat to the tubular body portion 210, which optionally includes fins 212 for dissipation of heat (e.g., from the emitters 204A-204B) to an ambient environment such as ambient air.

The reflector element 230 includes a reflective inner surface 231, an aperture 233 proximate to the tubular body portion 210, and a rim 234 proximate to the light-emitting end 202. As illustrated, the reflector element 230 is faceted, but a non-faceted reflector element may be substituted. One or more sensors 268 (e.g., photodiodes or other light sensors) may be arranged in, on, or proximate to the reflector 230 (or otherwise arranged to receive lumiphor-converted emissions 250B), and may be used to sense color, chromaticity, and/or intensity of lumiphor-converted emissions 250B, with the electrically activated emitters 220A-220B optionally being controllable responsive to at least one output signal of the one or more sensors 268. The lumiphor support element 241A preferably includes a reflective surface (i.e., to ensure reflection of electrically activated emitter emissions (i.e., beam 250A) toward the reflector 230) and is arranged between the lens 245 and the at least one lumiphoric material 241B. The lens 245 is arranged to support the lumiphor support element 241A and is arranged to enclose the cavity 238 defined by the reflector 230. The reflector element 230 and the lens 245 may be joined with an intermediate element 239 that may include a thermally insulating material and/or an adhesive. The at least one lumiphoric material 241B may include one or more lumiphoric materials which may be arranged uniformly or non-uniformly on the lumiphor support element 241A.

In operation of the lighting device 200, electrical power is supplied to the contacts 204A-204B and is optionally conditioned and/or controlled by the power conditioning and/or control components 203 (which may optionally include a ballast, with the device 200 constituting self-ballasted lighting device 200). Each electrically activated light emitting elements 220A-220B is energized to emit one or more light beams into the beam combining element 224 (which may or may not be wavelength sensitive, and may include at least one of a dichroic mirror, prism, a diffraction grating, a volume Bragg grating or the like), which combines the input beams. Optional beam adjustment and/or optical elements 222, 224, 225 may be provided upstream and/or downstream of the beam combining element, and may be used to adjust various properties of beams generated by the electrically activated emitters 220A-220B (including, but not limited to, directionality, focus, beam pattern, color mixing, collimation, etc.). Intensity, color, and/or chromaticity may also be adjusted by adjusting (e.g., separately adjusting) supply of power to the electrically activated emitters 220A-220B. Position and/or aiming of the electrically activated emitters 220A-220B may also be adjusted by affecting position of the emitter support elements 214A-214B, such as by using one or more actuators (not shown) or thermally responsive shape memory alloys for formation of the support elements 214A-214B or portions thereof. Emissions emanating from the electrically activated emitters 220A-220B are directed through the aperture 233 as beam 250A to impinge on the at least one lumiphoric material 241B. Part or all of the beam 250A may be absorbed by the at least one lumiphoric material 241B and re-emitted as a lumiphor-converted beam 250B (optionally including a portion of the beam 250A that is not absorbed by the at least one lumiphoric material and is reflected rearward by the lumiphor support element 241A) toward the reflective inner surface 231 of the reflector element 230. The lumiphor-converted beam 250B is reflected (e.g., in a forward direction) by the reflective inner surface 231 to form a reflected beam 250C that is transmitted toward the light-transmissive end 202, where such beam 250C is transmitted past the at least one lumiphoric material 241B and through the lens 245 to exit the lighting device 200. The lens 245 may optionally include or have associated therewith a diffuser, collimator, and/or other optical elements to affect color mixing and/or beam pattern output by the lighting device 200

Figure 2B:
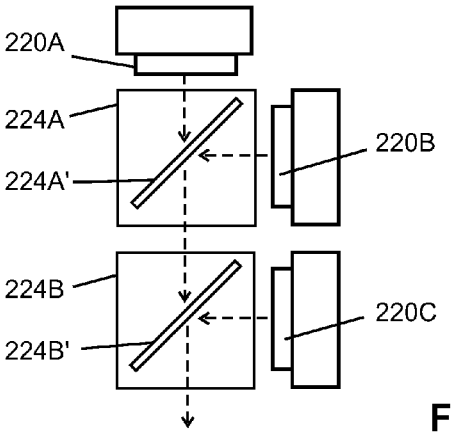
FIG. 2B is a side cross-sectional schematic view of three electrically activated emitters arranged with two beam combining elements to output a single beam, as may be used in an alternative arrangement of the lighting device according to FIG. 2A.

FIG. 2B is a side cross-sectional schematic view of three electrically activated emitters 220A-220C arranged with two beam combining elements 224A-224B (e.g., including dichroic mirrors 224A', 224B') to output a single beam, as may be used in an alternative arrangement of the lighting device 200 according to FIG. 2A. Such arrangement is provided to demonstrate that output beams any suitable number of electrically activated emitters may be combined into a single beam according to certain embodiments. It is to be appreciated that each electrically activated emitter 220A-220C may include an emitter package including multiple electrically activated emitters. Each electrically activated emitter 220A-220C may be arranged to output the same peak wavelength or different peak wavelengths, and each electrically activated emitter 220A-220C may be separately controllable.

Figure 3A:
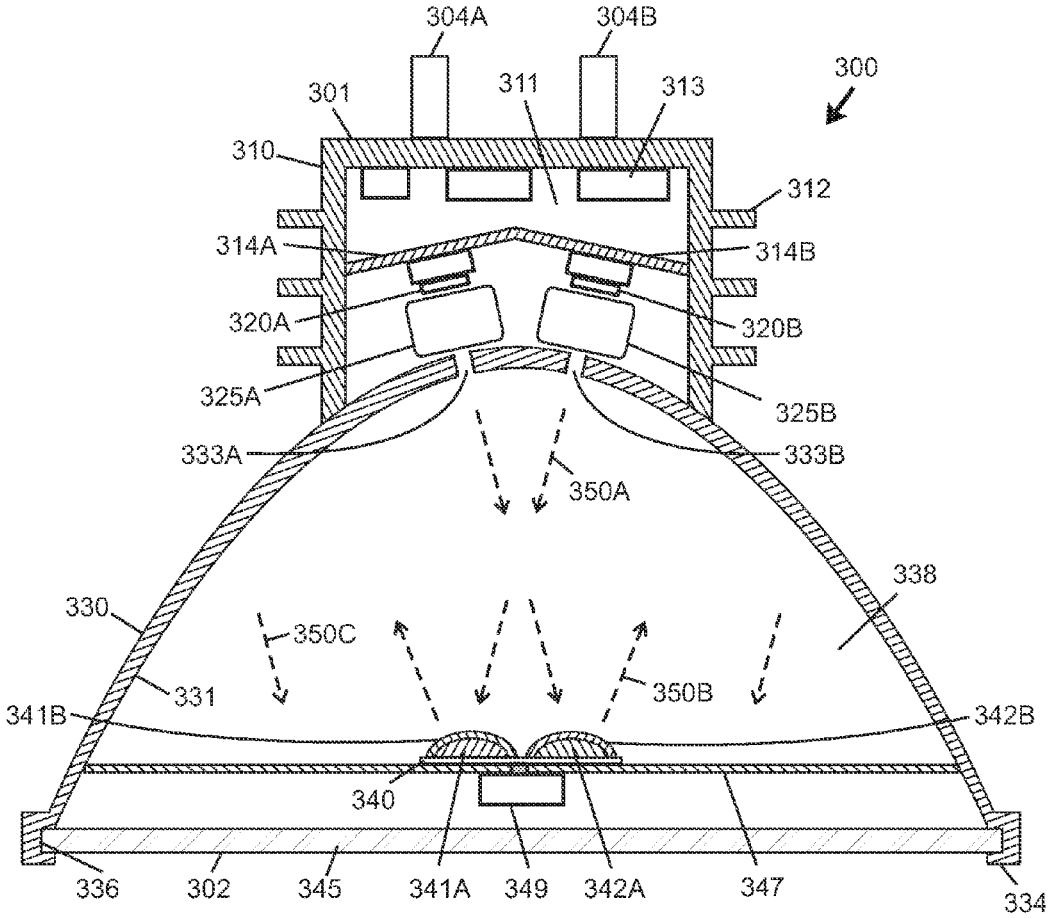
FIG. 3A is a side cross-sectional schematic view of a lighting device according to one embodiment including multiple electrically activated light emitters arranged to transmit light through multiple apertures defined in a cup-shaped reflector to impinge on at least one lumiphoric material supported by a lumiphor support surface and a support structure including spokes arranged within a cavity of the reflector, with the at least one lumiphoric material arranged to emit light rearward toward the reflector for reflection of light toward a light-emitting end of the lighting device.
Figure 3B:
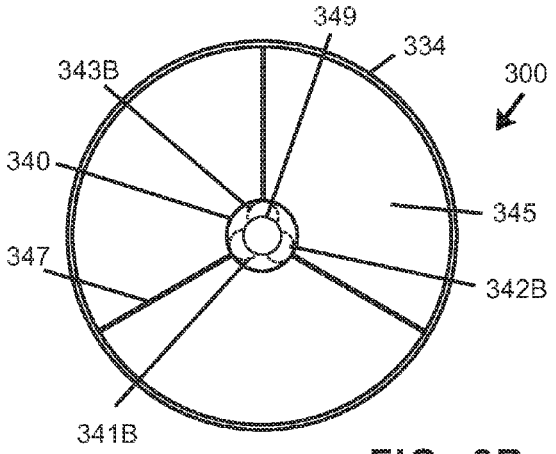
FIG. 3B is a front elevation view of the lighting device of FIG. 3A.

FIGS. 3A-3B illustrate a lighting device 300 according to one embodiment including multiple electrically activated light emitters 320A-320B arranged to transmit light through multiple apertures 333A-333B defined in a cup-shaped reflector 330 to impinge on multiple (e.g., hemispherical shaped) lumiphoric materials 341B-342B supported by lumiphor support elements 341A-341B and spokes 347 arranged within the cavity 338 of the reflector 330. The lighting device 300 includes a base end 301 with electrical contacts 304A-304B, and a light-emitting end 302 opposite the base end 301, with a tubular body portion 310 proximate to the base end 301. The tubular body portion 310 includes an interior 311 containing power conditioning and/or control components 313 (e.g., optionally including a ballast with the device 300 comprising a self-ballasted lamp), emitter support element 314A-314B arranged to support electrically activated light emitting elements 320A-320B, and optional beam adjustment and/or optical elements 325A-325B. As shown in FIG. 3A, the width of the reflector 330 is greater than the width of the body portion 310 containing the light emitting elements 320A-320B, and the width of the interior 311 of the body portion 310 is greater than the width of each aperture 333A, 333B defined in the reflector 330. Although FIG. 3A illustrates discrete electrically activated light emitting elements 320A-320B, it is to be appreciated that one or more of such elements 320A-320B may include multiple emitters (e.g., optionally combinable in emitter packages). The electrically activated emitters 320A-320B may be arranged to emit substantially the same peak wavelength or different peak wavelengths. In certain embodiments, each electrically activated light emitter 320A-320B is separately controllable. While solid state light emitting devices (e.g., lasers and/or LEDs) may be provided in preferred embodiments, any suitable type of electrically activated light emitting devices may be used separately or together in embodiments of the invention. The emitter support elements 314A-314B are preferably arranged to conduct heat to the tubular body portion 310, which optionally includes fins 312 for dissipation of heat (e.g., from the emitters 304A-304B) to an ambient environment such as ambient air.

The reflector element 330 includes a reflective inner surface 331, multiple apertures 333A-333B proximate to the tubular body portion 310, a rim 334 proximate to the light-emitting end 302, and a recess 336 arranged to retain a lens 345 proximate to the light-emitting end 302. Spokes 347 extend from walls of the reflector element 330 and are arranged within the recess 338 to support a lumiphor base 340 over which multiple lumiphor support elements 341A-343A and corresponding lumiphor material regions 341B-343B are arranged. Each lumiphor support element 341A-343A preferably includes a reflective surface (i.e., to ensure reflection of electrically activated emitter emissions (i.e., beam 350A) toward the reflector 330). An optional actuator 349 may be further supported by the spokes 347 and may be arranged to adjust position (e.g., translational and/or rotational position) of the lumiphor base 340 and correspondingly the position of lumiphor material regions 341B-343B. Each lumiphoric material region 341B-343B may include one or more lumiphoric materials that may be arranged uniformly or non-uniformly on the corresponding lumiphor support elements 341A-343A. The lens 345 is arranged to enclose the cavity 338 defined by the reflector element 330.

In operation of the lighting device 300, electrical power is supplied to the contacts 304A-304B and is optionally conditioned and/or controlled by the power conditioning and/or control components 303 (which may optionally include a ballast, with the device 300 constituting self-ballasted lighting device 300). Each electrically activated light emitting elements 320A-320B is energized to emit one or more light beams. Optional beam adjustment and/or optical elements 325A-325B may be used to adjust various properties of beams generated by the electrically activated emitters 320A-320B (including, but not limited to, directionality, focus, beam pattern, color mixing, collimation, etc.). Intensity, color, and/or chromaticity may also be adjusted by adjusting (e.g., separately adjusting) supply of power to the electrically activated emitters 320A-320B. Position and/or aiming of the electrically activated emitters 320A-320B may also be adjusted by affecting position of the emitter support elements 314A-314B, such as by using one or more actuators (not shown) or thermally responsive shape memory alloys for formation of the support elements 314A-314B or portions thereof. Emissions emanating from the electrically activated emitters 320A-320B are directed through the apertures 333A-333B as beams 350A to impinge on the lumiphoric materials 341B-343B. Part or all of the beams 350A may be absorbed by the lumiphoric materials 341B-343B and re-emitted as lumiphor-converted beams 350B (optionally including portions of the beams 350A that are not absorbed by the lumiphoric materials 341B-343B and are reflected rearward by the lumiphor support elements 341A-343A underlying the lumiphoric materials 341B-343B) toward the reflective inner surface 331 of the reflector element 330. The lumiphor-converted beams 350B are reflected (e.g., in a forward direction) by the reflective inner surface 331 to form reflected beams 350C that are transmitted toward the light-transmissive end 302, where such beams 350C are transmitted past lumiphor base 340 and spokes, and through the lens 345, to exit the lighting device 300. Optionally, position of the lumiphoric materials 341B-343B may be adjusted (e.g., translated and/or rotated) by the actuator 349, to affect interaction between the beams 350A and the lumiphoric materials 341B-343B and thereby affect output of the lighting device. The lens 345 may optionally include or have associated therewith a diffuser, collimator, and/or other optical elements to affect color mixing and/or beam pattern output by the lighting device 300.

Figure 4A:
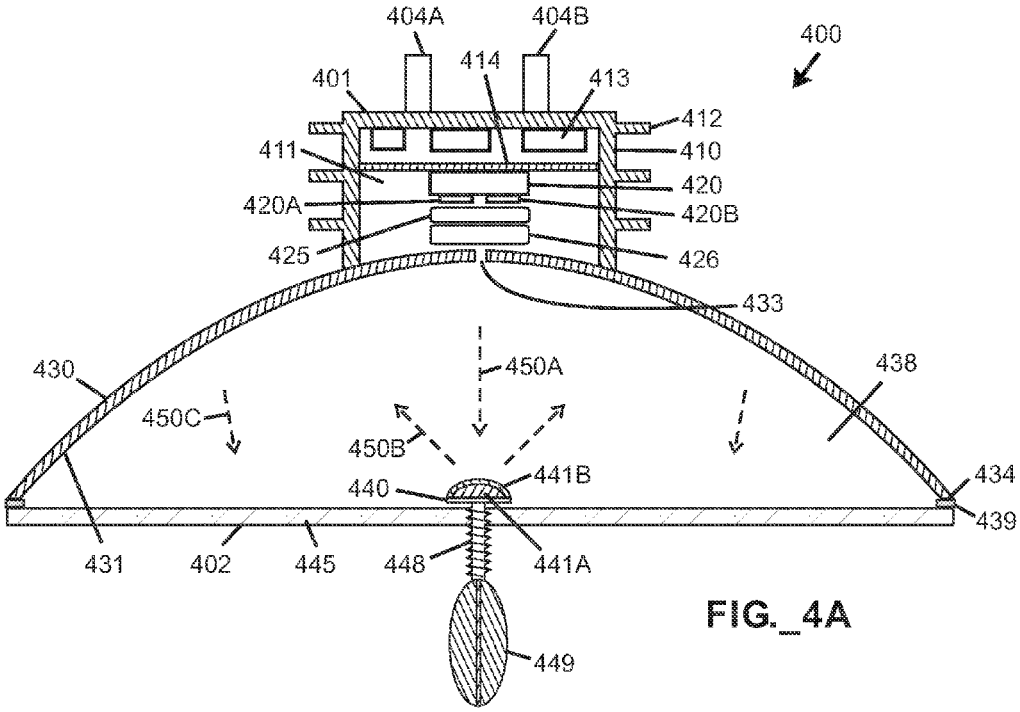
FIG. 4A is a side cross-sectional schematic view of a lighting device according to one embodiment including multiple electrically activated light emitters arranged to transmit light through an aperture defined in a cup-shaped reflector to impinge on at least one lumiphoric material supported by a lumiphor support element in a first position and arranged for positional adjustment with a user-accessible adjustment element, with the at least one lumiphoric material arranged to emit light rearward toward the reflector for reflection of light toward a light-emitting end of the lighting device.
Figure 4B:
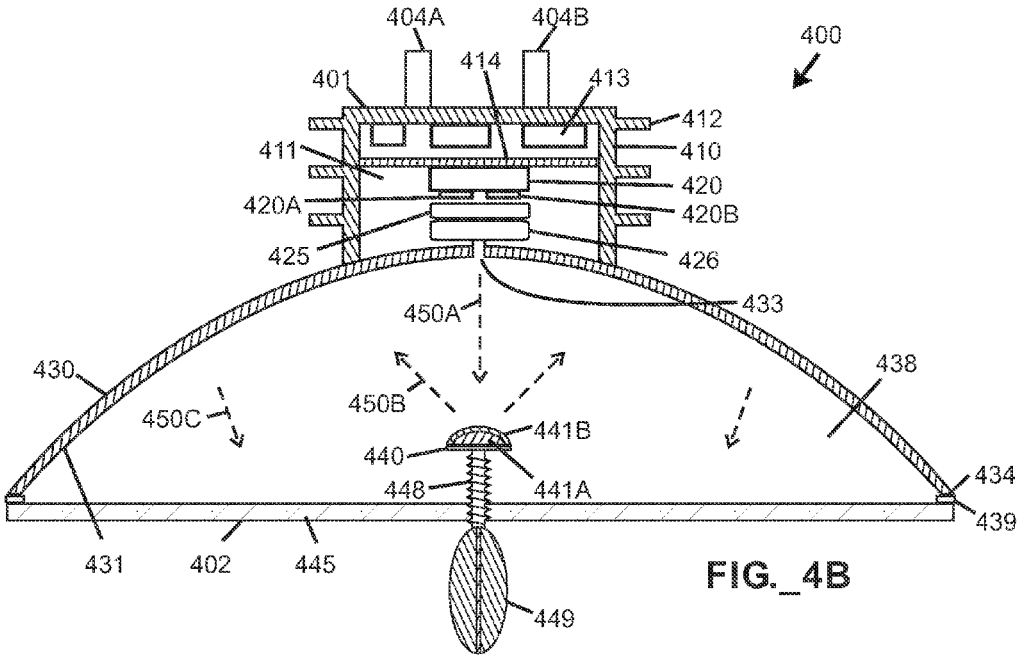
FIG. 4B is a side-cross sectional schematic view of the lighting device of FIG. 4A, with the lumiphor support element in a second position (i.e., arranged closer to the solid state light emitter than the arrangement shown in FIG. 4A).

FIGS. 4A-4B illustrate a lighting device 400 according to one embodiment including one or more electrically activated light emitters 420A-420B arranged to transmit light through an aperture 433 defined in a cup-shaped reflector 430 to impinge on at least one lumiphoric material 441B disposed between the reflector 430 and a lens 402 that is arranged to enclose a reflector cavity 438. The lighting device 400 includes a base end 401 with electrical contacts 404A-404B, and a light-emitting end 402 opposite the base end 401, with a tubular body portion 410 proximate to the base end 401. The tubular body portion 410 includes an interior 411 containing power conditioning and/or control components 413, an emitter support element 414, an emitter package 420 including light emitting elements 420A-420B, and optional beam adjustment and/or optical elements 425A-425B. As shown in FIGS. 4A and 4B, the width of the reflector 430 is greater than the width of the body portion 410 containing the light emitting elements 420A-420B, and the width of the interior 411 of the body portion 410 is greater than the width of the aperture 433 defined in the reflector 430. Although FIG. 4A illustrates multiple electrically activated light emitting elements 420A-420B as being associated with an emitter package 420 (e.g., a multi-LED package), it is to be appreciated that any suitable number of one or more electrically activated light emitters may be provided, whether as discrete components or combined in one or more packages. The electrically activated emitters 420A-420B may be arranged to emit substantially the same peak wavelength or different peak wavelengths. In certain embodiments, each electrically activated light emitter 420A-420B is separately controllable. While solid state light emitting devices (e.g., lasers and/or LEDs) may be provided in preferred embodiments, any suitable type of electrically activated light emitting devices may be used separately or together in embodiments of the invention. The emitter support element 414 is preferably arranged to conduct heat to the tubular body portion, which optionally includes fins 412 for dissipation of heat (e.g., from the emitters 404A-404B) to an ambient environment such as ambient air. The reflector element 430 includes a reflective inner surface 431, an aperture 433 proximate to the tubular body portion 410, and a rim 434 proximate to the light-emitting end 402. The reflector element 430 and the lens 445 may be joined with an intermediate element 439 that may include a thermally insulating material and/or an adhesive.

The at least one lumiphoric material 441B may include one or more lumiphoric materials, which may be arranged uniformly or non-uniformly on a lumiphor support element 441A preferably including a reflecting material to promote reflection of electrically activated emitter emissions (i.e., beam 450A) toward the reflector 430. The at least one lumiphoric material 441B and lumiphor support element 441A may be arranged on a lumiphor support base 440 coupled to a screw or other movable element 448 that extends through the lens 445 and is coupled to an adjustment element and/or heatsink 449 that may be optionally shaped as a knob to be grasped and manipulated by a user. The adjustment element and/or heatsink 449 may be arranged to dissipate heat from the at least one lumiphoric material 441B to an ambient environment, and upon manipulation by a user, the adjustment element and/or heatsink 449 may be used to adjust position (e.g., rotational and/or translational position) of the at least one lumiphoric material 441B. FIG. 4A shows the lighting device 400 with the adjustment element and/or heatsink element 449 and associated screw or movable element 448 in a first position whereby the lumiphor support base 440 (and associated least one lumiphoric element 441B) is proximate to the lens 445, whereas FIG. 4B shows the same lighting device 400 with the adjustment element and/or heatsink element 449 and associated screw or movable element 448 in a second position (e.g., with the lumiphor support base 440 and associated least one lumiphoric element 441B closer to the aperture 433 defined in the reflector element 430).

In operation of the lighting device 400, electrical power is supplied to the contacts 404A-404B and is optionally conditioned and/or controlled by the power conditioning and/or control components 403 (which may optionally include a ballast, with the device 400 constituting self-ballasted lighting device 400). The electrically activated light emitting elements 420A-420B are energized to emit one or more light beams. Various properties of the one or more light beams (including, but not limited to, directionality, focus, beam pattern, color mixing, and the like) may be adjusted using the at least one beam adjustment element 425 and/or the at least one optical element 426. Intensity, color, and/or chromaticity may also be adjusted by adjusting (e.g., separately adjusting) supply of power to the electrically activated emitters 420A-420B. Although the at least one beam adjustment element 425 is illustrated in FIG. 4A as being optically downstream of the electrically activated emitters 420A-420B, in certain embodiments, at least one beam adjustment element 425 may be intermediately arranged between the emitter support element 414 and the electrically activated emitters 420A-420B (or package 420) to adjust position or directional aiming of the electrically activated emitters 420A-420B. One or more optical elements 426 may be used in addition to, or instead of, one or more beam adjustment elements 426, to adjust one or more properties (e.g., focus, collimation, beam pattern, etc.) of emissions of the electrically activated emitters 420A-420B. Emissions emanating from the electrically activated emitters 420A-420B are directed through the aperture 433 as beam 450A to impinge on the at least one lumiphoric material 441B. Part or all of the beam 450A may be absorbed by the at least one lumiphoric material 441B and re-emitted as a lumiphor-converted beam 450B (optionally including a portion of the beam 450A that is reflected rearward by the at least one lumiphoric material 441 or an associated reflective substrate (not shown) emitted toward the reflective inner surface 431 of the reflector element 430. The lumiphor-converted beam 450B is reflected (e.g., in a forward direction) by the reflective inner surface 431 to form a reflected beam 450C that is transmitted toward the light-transmissive end 402, where such beam 450C is transmitted past the at least one lumiphoric material 441B and through the lens 445 to exit the lighting device 400. Manipulation of the (mechanical) adjustment element and/or heatsink 449 may be performed to further affect interaction between the beam 450A and the at least one lumiphoric material 441B, such as to affect color, chromaticity, beam pattern, color mixing, or other characteristics of the resulting beams 450B-450C. The lens 445 may optionally include or have associated therewith a diffuser, collimator, and/or other optical elements to affect color mixing and/or beam pattern output by the lighting device 400.

Figure 5:
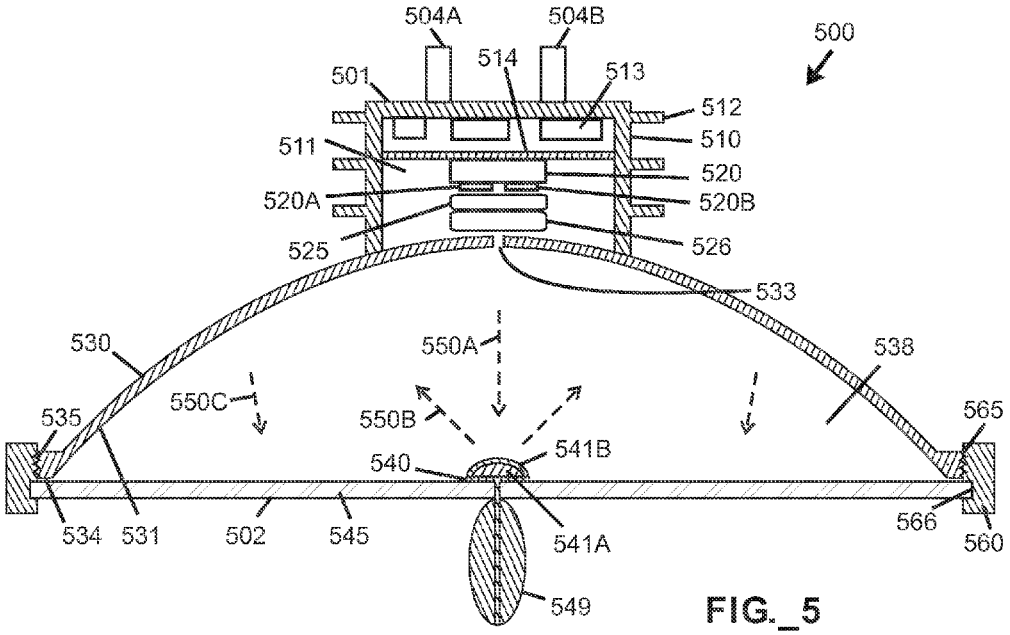
FIG. 5 is a side cross-sectional schematic view of a lighting device according to one embodiment including multiple electrically activated light emitters arranged to transmit light through an aperture defined in a cup-shaped reflector to impinge on at least one lumiphoric material supported by a lumiphor support element proximate to a lens, with the lighting device including at least one adjustment element arranged to adjust position (e.g., rotational position) of the lumiphor support element, and with the at least one lumiphoric material arranged to emit light rearward toward the reflector for reflection of light toward a light-emitting end of the lighting device.

FIG. 5 illustrate a lighting device 500 according to one embodiment including one or more electrically activated light emitters 520A-520B arranged to transmit light through an aperture 533 defined in a cup-shaped reflector 530 to impinge on at least one lumiphoric material 541B disposed between the reflector 530 and a lens 502 arranged to enclose a reflector cavity 538. The lighting device 500 includes a base end 501 with electrical contacts 504A-504B, and a light-emitting end 502 opposite the base end 501, with a tubular body portion 510 proximate to the base end 501. The tubular body portion 510 includes an interior 511 containing power conditioning and/or control components 513, an emitter support element 514, an emitter package 520 including light emitting elements 520A-520B, and optional beam adjustment and/or optical elements 525A-525B. As shown in FIG. 5A, the width of the reflector 530 is greater than the width 510 of the body portion 510 containing the light emitting elements 520A-520B, and the width of the interior 511 of the body portion 510 is greater than the width of the aperture 533 defined in the reflector 530. Although FIG. 5A illustrates multiple electrically activated light emitting elements 520A-520B as being associated with an emitter package 520 (e.g., a multi-LED package), it is to be appreciated that any suitable number of one or more electrically activated light emitters may be provided, whether as discrete components or combined in one or more packages. The electrically activated emitters 520A-520B may be arranged to emit substantially the same peak wavelength or different peak wavelengths. In certain embodiments, each electrically activated light emitter 520A-520B is separately controllable. While solid state light emitting devices (e.g., lasers and/or LEDs) may be provided in preferred embodiments, any suitable type of electrically activated light emitting devices may be used separately or together in embodiments of the invention. The emitter support element 514 is preferably arranged to conduct heat to the tubular body portion, which optionally includes fins 512 for dissipation of heat (e.g., from the emitters 504A-504B) to an ambient environment such as ambient air. The reflector element 530 includes a reflective inner surface 531, an aperture 533 proximate to the tubular body portion 510, and a rim 534 proximate to the light-emitting end 502.

A moveable (e.g., rotatable) bezel 560 includes a recess 566 arranged to retain the lens 545 and a female threaded surface 565 arranged to engage a male threaded surface 535 along the rim 535 of the reflector element 530. Although threaded surfaces 565, 536 are shown, it is to be appreciated that any suitable type of moveable mechanical (e.g., rotatable or translatable) interface between the bezel 560 and the reflector element 530 may be provided, including but not limited to use of detent elements, protrusion/slot arrangements, telescoping elements, and the like. Preferably, the bezel 560 is accessible along an exterior of the lighting device 500 and is arranged to be manually adjustable by a user. Adjusting position of the bezel 565 may be used to adjust position (e.g., rotational and/or translational position) of the at least one lumiphoric material 541B relative to a beam 550 received from the electrically activated emitters 520A-520B, and thereby adjust various properties of lumiphor converted beams 550B (including, but not limited to, directionality, focus, beam pattern, color mixing, etc.). In certain embodiments, the bezel may be removed by rotation of the bezel 560, such as may be useful to permit replacement of the lens 545 (e.g., to adjust focus, collimation, directionality, color mixing, filtering, beam patterning, diffusion, and/or other output characteristics) and/or permit replacement of the at least one lumiphoric material 541B.

The at least one lumiphoric material 541B may include one or more lumiphoric materials, which may be arranged uniformly or non-uniformly on a lumiphor support element 541A preferably including a reflecting material to promote reflection of electrically activated emitter emissions (i.e., beam 550A) toward the reflector 530. The at least one lumiphoric material 541B and lumiphor support element 541A may be arranged on a lumiphor support base 540 in conductive thermal communication with a heatsink 549 arranged exterior to the reflector cavity 538 to dissipate heat from the at least one lumiphoric material 541B. The heatsink 549 may optionally double as an adjustment element (e.g., manually graspable by a user) to permit positional (e.g., rotational) adjustment of the lumiphor support base 540 and concomitantly the at least one lumiphoric material 541B arranged thereover.

In operation of the lighting device 500, electrical power is supplied to the contacts 504A-504B and is optionally conditioned and/or controlled by the power conditioning and/or control components 503 (which may optionally include a ballast, with the device 500 constituting self-ballasted lighting device 500). The electrically activated light emitting elements 520A-520B are energized to emit one or more light beams. Various properties of the one or more light beams (including, but not limited to, directionality, focus, beam pattern, color mixing, and the like) may be adjusted using the at least one beam adjustment element 525 and/or the at least one optical element 526. Intensity, color, and/or chromaticity may also be adjusted by adjusting (e.g., separately adjusting) supply of power to the electrically activated emitters 520A-520B. Although the at least one beam adjustment element 525 is illustrated in FIG. 5A as being optically downstream of the electrically activated emitters 520A-520B, in certain embodiments, at least one beam adjustment element 525 may be intermediately arranged between the emitter support element 514 and the electrically activated emitters 520A-520B (or package 520) to adjust position or directional aiming of the electrically activated emitters 520A-520B. One or more optical elements 526 may be used in addition to, or instead of, one or more beam adjustment elements 526, to adjust one or more properties (e.g., focus, collimation, beam pattern, etc.) of emissions of the electrically activated emitters 520A-520B. Emissions emanating from the electrically activated emitters 520A-520B are directed through the aperture 533 as a beam 550A to impinge on the at least one lumiphoric material 541B. Part or all of the beam 550A may be absorbed by the at least one lumiphoric material 541B and re-emitted as a lumiphor-converted beam 550B (optionally including a portion of the beam 550A that is reflected rearward by the lumiphor support 541A) emitted toward the reflective inner surface 531 of the reflector element 530. The lumiphor-converted beam 550B is reflected (e.g., in a forward direction) by the reflective inner surface 531 to form a reflected beam 550C that is transmitted toward the light-transmissive end 502, where such beam 550C is transmitted past the at least one lumiphoric material 541B and through the lens 545 to exit the lighting device 500. Manipulation of (mechanical) adjustment elements (e.g., the bezel 560 or the heatsink/adjustment knob 549) may be performed to further affect interaction between the beam 550A and the at least one lumiphoric material 541B, such as to affect color, chromaticity, beam pattern, color mixing, or other characteristics of the resulting beams 550B-550C. The lens 545 may optionally include or have associated therewith a diffuser, collimator, and/or other optical elements to affect color mixing and/or beam pattern output by the lighting device 500.

Figure 6:
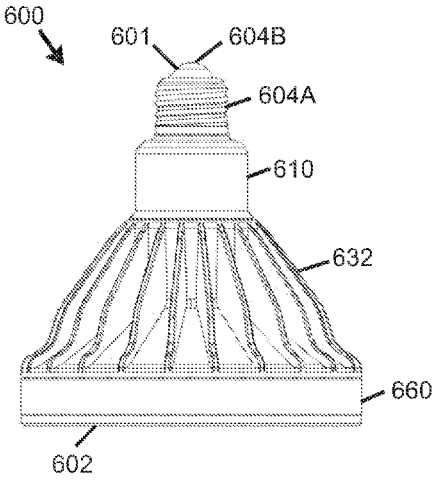
FIG. 6 is a side elevation view of a lighting device according to one embodiment including an externally accessible heatsink, a tubular body portion, and an Edison screw-type base.

FIG. 6 is a side elevation view of a (preferably self-ballasted) lighting device 600 according to one embodiment, the lighting device 600 including an externally accessible heatsink 632, a tubular body portion 610, and an Edison screw-type base end 601 (including a (threaded) lateral contact 604A and a foot contact 604B) arranged opposite a light emitting end 602. A bezel 660 is arranged between the heatsink 632 and the light-emitting end 602. The heatsink 632 includes fins arranged substantially perpendicular to the light-emitting end 602 and extending between the tubular body portion 610 and the bezel 660. The lighting device 600 is illustrated to demonstrate that various types and configurations of electrical contacts and heatsinks may be used in lighting devices as disclosed herein.

Figure 7:
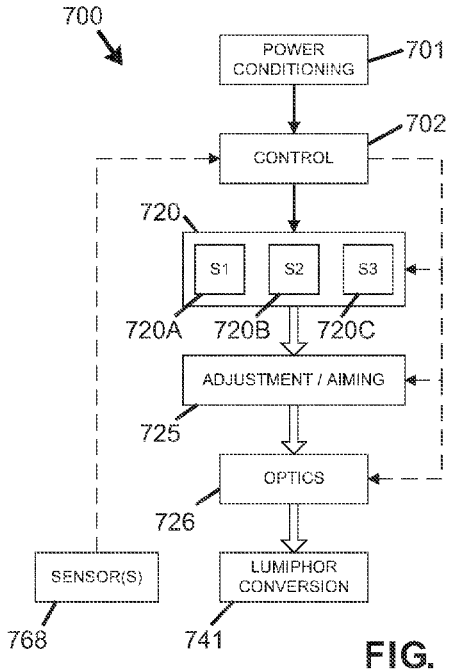
FIG. 7 is an interconnection diagram showing connections and/or interactions between various elements of a lighting device including multiple electrically activated emitters and at least one lumiphoric material that is spatially separated from the electrically activated emitters.

FIG. 7 is an interconnection diagram showing connections and/or interactions between various elements of a lighting device 700 including multiple electrically activated emitters 720A-720C and at least one lumiphoric material 741 that is spatially separated from the electrically activated emitters. The lighting device 700 includes at least one power conditioning element 701, at least one control element 702, an emitter support or package 720 including one or more (preferably multiple) electrically activated emitters 720A-720C, one or more adjustment or aiming elements 725, at least one optical element 726, and at least one lumiphoric material 741 arranged to receive emissions from the at least one electrically activated emitter 720A-720C. One or more sensors 768 may be used to sense any desirable characteristic (e.g., color, chromaticity, luminous flux, etc.) of emissions of the device (e.g., lumiphor converted emissions), and operation of the lighting device 700 may be controlled responsive to output signal(s) of the one or more sensors 768.

FIGS. 8A-8L are rear plan views (i.e., showing lumiphoric materials as positioned to receive emissions from electrically activated emitters of lighting devices as disclosed herein) of various arrangements of one or more lumiphors arranged to be spatially segregated from electrically activated light emitters according to various embodiments. Although FIGS. 8A, 8B, and 8D-8L illustrate lumiphor supports having generally circular shapes, it is to be appreciated that lumiphor supports may be arranged in any desirable shape, and that various configurations of one or more lumiphors are possible in addition to the exemplary lumiphor configurations specifically disclosed herein.

Figure 8A:
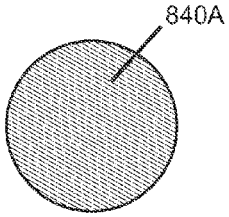
FIGS. 8A-8L are rear plan views of various arrangements of one or more lumiphors arranged to be spatially segregated from electrically activated light emitters and useful with lighting devices according to various embodiments.

FIG. 8A illustrates at least one lumiphoric material 840A arranged uniformly over a lumiphor support.

Figure 8B:
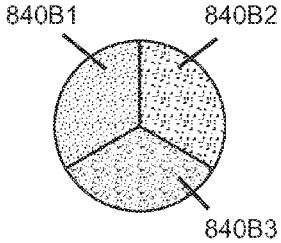
Figure 8C:
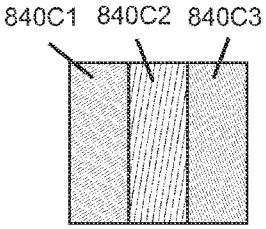

In certain embodiments, sharp boundaries may be provided between different lumiphor-containing regions. For example, FIG. 8B illustrates lumiphoric materials (e.g., having different patterns, compositions, amounts, and/or concentrations) segregated into three different wedge-shaped regions 840B1-840B3. FIG. 8C illustrates lumiphoric materials (e.g., having different patterns, compositions, amounts, and/or concentrations) segregated into three different rectangular areas 840C1-840C3.

Figure 8D:
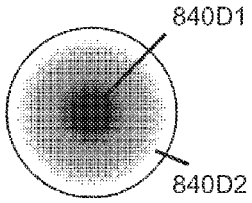
Figure 8E:
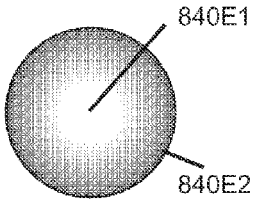
Figure 8F:
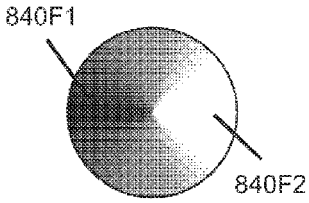

In certain embodiments, lumiphoric materials may be arranged with patterns, compositions, amounts, and/or concentrations that vary with position according to a gradient. Examples are illustrated in FIGS. 8D-8F. FIG. 8D illustrates a lumiphor support including a central region 840D1 with a greater concentration or amount of at least one (e.g., first) lumiphoric material, and a peripheral region 840D2 with a lesser concentration or amount of the at least one (first) lumiphoric material (or an absence of first lumiphoric material), wherein the peripheral region 840D2 optionally includes at least one compositionally different second lumiphoric material in an amount or concentration that differs from the central region 840D1. FIG. 8E illustrates the opposite situation from FIG. 8D; in FIG. 8E a central region 840E1 has a lesser concentration or amount of at least one (e.g., first) lumiphoric material, and a peripheral region 840E2 has a greater concentration or amount of the first lumiphoric material. One or both of the central region 840E1 and the peripheral region 840E2 may optionally include at least one second lumiphoric material that is compositionally different from the at least one first lumiphoric material. FIG. 8F illustrates a lumiphor support including a left side region 840F1 with a greater concentration or amount of at least one (e.g., first) lumiphoric material, and a right side region 840F2 with a lesser concentration or amount of the at least one (first) lumiphoric material, wherein the right side region 840F2 optionally includes at least one compositionally different second lumiphoric material in an amount or concentration that differs from the left side region 840F1.

Figure 8G:
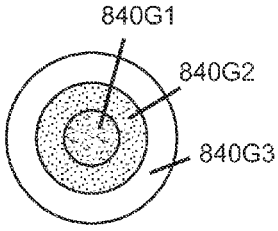
Figure 8H:
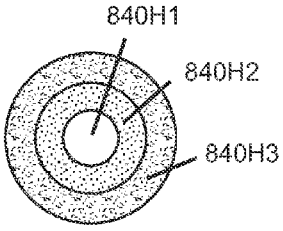
Figure 8I:
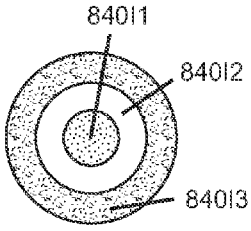

In certain embodiments, lumiphoric materials (or regions absent lumiphoric materials) may be arranged over a lumiphor support in concentric shapes (e.g., concentric circular shapes) with non-gradient boundaries. Examples are shown in FIGS. 8G-8I, each of which illustrate a lumiphor support with three concentrically arranged circular regions 840G1-840G3, 840H1-840H3, 840I1-840I3 which may include regions of differing lumiphor composition, amount, concentration, or pattern. One or more of such regions 840G1-840G3, 840H1-840H3, 840I1-840I3 may optionally be devoid of any lumiphoric material. In one embodiment, a central region 840G1 may have a greatest concentration or first color of lumiphoric material, a peripheral region 840G3 may have a least concentration or second color of lumiphoric material (or, optionally, absence of lumiphoric material), and an intermediate region 840G2 may have an intermediate concentration or differing color condition, such as shown in FIG. 8G. In one embodiment, a central region 840H1 may have a least concentration or first color of lumiphoric material (or absence of lumiphoric material), a peripheral region 840H3 may have a greatest concentration or second color of lumiphoric material, and an intermediate region 840H2 may have an intermediate concentration or differing color condition, such as shown in FIG. 8H. In one embodiment, an intermediate region 840I2 may have a least concentration or color of lumiphoric material, and a central region 840I1 and a peripheral region 840I3 may have concentrations or colors of lumiphoric material that differ from the intermediate region 840I2, as shown in FIG. 8I.

Figure 8J:
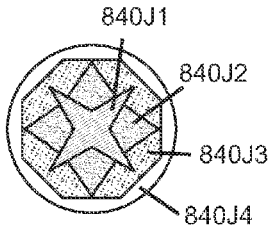
Figure 8K:
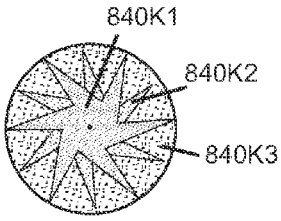

Further concentric configurations of lumiphoric material containing regions are shown in FIGS. 8J-8K. FIG. 8J illustrates a lumiphor support including first through fourth concentrically arranged overlapping regions 840J1-840J4 (including a first region 840J1 having a four-pointed star-shaped perimeter, a second region 840J2 having a diamond-shaped perimeter, a third region 840J3 having an octagonal perimeter, and a fourth region 840J4 having a circular perimeter), with such regions 840J1-840J4 preferably having different concentrations, amounts, colors, patterns, or presence of lumiphoric materials. FIG. 8K illustrates a lumiphor support including first through third concentrically arranged overlapping regions 840K1-840K3 (including a first region 840K1 having a six-pointed perimeter, a second region 840K2 having an angularly offset six-pointed perimeter, and a third region 840K3 having a circular perimeter, with such regions 840K1-840K3 preferably having different concentrations, amounts, colors, patterns, or presence of lumiphoric materials.

Figure 8L:
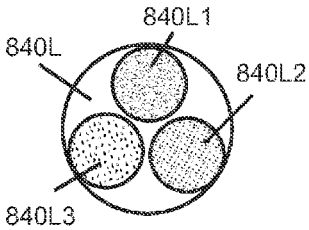

FIG. 8L illustrates lumiphoric materials (e.g., having different patterns, compositions, amounts, and/or concentrations) segregated into three different circular-shaped regions 840L1-840L3 arranged within a fourth circular shaped circumscribing region 840L (which may include one or more lumiphoric materials, or be devoid of any lumiphoric material).

Figure 9A:
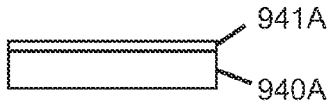
FIGS. 9A-9H are side cross-sectional views of lumiphors and lumiphor support elements arranged to be spatially segregated from electrically activated light emitters and useful with lighting devices according to various embodiments.
Figure 9B:
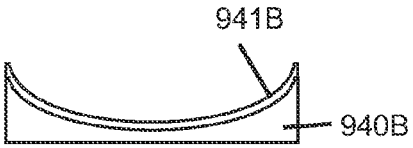
Figure 9C:
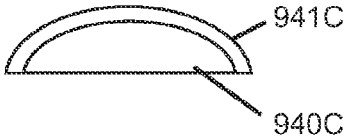
Figure 9D:
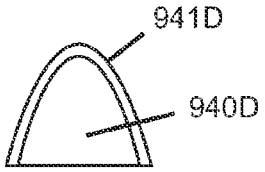
Figure 9E:
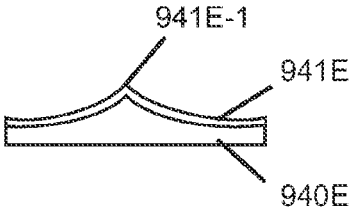
Figure 9F:
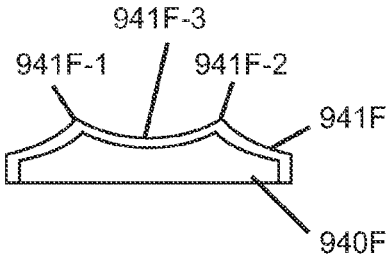
Figure 9G:
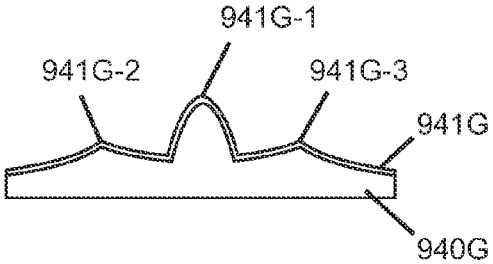
Figure 9H:
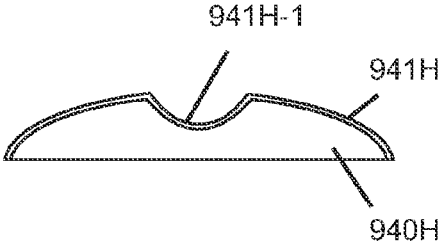

FIGS. 9A-9H are side cross-sectional views of lumiphors and lumiphor support elements arranged to be spatially segregated from electrically activated light emitters and useful with lighting devices as disclosed herein. Lumiphoric materials may be arranged over lumiphor supports in flat, concave, convex, mixed concave/convex, faceted, or other configurations that may be symmetric or non-symmetrically arranged. FIG. 9A illustrates a substantially flat lumiphor support element 940A overlaid with at least one lumiphoric material 941A having a similarly flat configuration. FIG. 9B illustrates a lumiphor support element 940B and at least one lumiphoric material 941B that are concave in shape. FIG. 9C illustrates a lumiphor support element 940C and at least one lumiphoric material 941C that are convex (e.g., hemispherical) in shape. FIG. 9D illustrates a lumiphor support element 940D and at least one lumiphoric material 941D that are convex (e.g., rounded conical shaped or bullet-shaped). FIG. 9E illustrates a lumiphor support element 940E overlaid with at least one lumiphoric material 941E including a central peak 941E-1 and downwardly-sloping curved wall portions that optionally may form a surface with discrete facets. FIG. 9F illustrates a mixed concave/convex lumiphor support element 940F overlaid with at least one lumiphoric material 941F including multiple peaks 941F-1, 941F-2, a concave central region 941F-3, and curved wall portions that slope downwardly from the peaks 941F-1, 941F-2 toward a perimeter. FIG. 9G illustrates a lumiphor support element 940G overlaid with at least one lumiphoric material 941G including multiple peaks 941G-1, 941G-2, 941G-3 (with central peak 941G-3 being bullet-shaped and larger than the other peaks), and curved wall portions that slope downwardly from the non-central peaks 941G-1, 941G-2 toward a perimeter. FIG. 9H illustrates a illustrates a mixed concave/convex lumiphor support element 940H overlaid with at least one lumiphoric material 941H including a central concave region 941H-1 arranged within an otherwise concave shape with wall portions that slope downward toward a perimeter.

Although lumiphoric material regions illustrated in FIGS. 9A-9H are illustrated without fill to promote clarity, it is to be appreciated that such regions may have any suitable uniform or non-uniform patterns of one or more lumiphoric materials as disclosed herein (e.g., in connection with FIGS. 8A-8L).

Embodiments as disclosed herein may provide one or more of the following beneficial technical effects: increasing reliability, improving color stability, and prolonging useful service life of a lighting device including a lumiphoric material (e.g., by separating lumiphoric materials from electrically activated emitters); enabling greater concentrations and/or amounts of phosphor materials to be used in lighting devices without unduly attenuating or blocking emissions from exiting a lighting device; providing lighting devices with favorable optical characteristics (e.g., reduced glare and/or improved beam patter) and favorable heat transfer characteristics, while eliminating the need for heatpipes and permitting the use of lumiphoric materials remotely located from electrically activated emitters; promoting heat extraction from lumiphoric materials; providing light emissions with high color rendering index and color quality scale characteristics; providing lighting devices with readily adjustable output color and/or chromaticity; and providing lighting devices with adjustable focus, adjustable beam pattern, and/or adjustable color mixing characteristics Any of the various features and elements as disclosed herein may be combined with, and are specifically contemplated for combination with, one or more other disclosed features and elements unless indicated to the contrary herein While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Various combinations and sub-combinations of the structures described herein are contemplated and will be apparent to a skilled person having knowledge of this disclosure. Correspondingly, the invention as hereinafter claimed is intended to be broadly construed and interpreted, as including all such variations, modifications and alternative embodiments, within its scope and including equivalents of the claims.

What is claimed is:

1. A lighting device comprising:

a base end;

electrical contacts associated with the base end;

a light-transmissive end;

at least one solid state light emitting source;

a reflector comprising a cup-shaped body including (i) a reflective surface, (ii) at least one aperture arranged to enable transmission of light emissions of the at least one solid state light emitting source through the at least one aperture, and (iii) a light-transmissive opening arranged to permit transmission of light reflected by the reflector toward the light-transmissive end;

at least one lumiphoric material that is spatially segregated from the at least one solid state light emitting source, that is arranged to receive at least a portion of the light emissions of the at least one solid state light emitting source, and that is arranged to emit lumiphor-converted light emissions toward the reflector; and a lens proximate to the light-transmissive opening of the reflector;

wherein the reflector is arranged to reflect lumiphor-converted light emissions toward the light-transmissive end; and wherein the lighting device comprises at least one of the following features (a) or (b):

(a) the lighting device includes a support structure that is distinct from the lens and is arranged to support the at least one lumiphoric material between the lens and the at least one aperture, wherein the support structure and the at least one lumiphoric material are spatially separated from and devoid of contact with the lens; and (b) the lighting device includes a heat sink arranged external to the lens, arranged in conductive thermal communication with the at least one lumiphoric material, and arranged to dissipate heat from the at least one lumiphoric material to an ambient air environment, wherein the heat sink includes a screw or movable element extending from a lumiphoric material support structure through the lens, and movement of the heat sink is arranged to cause movement of the at least one lumiphoric material.

2. The lighting device according to claim 1, wherein the at least one lumiphoric material is arranged on or over at least one reflective support surface, a portion of the light emissions of the at least one solid state light emitting source is absorbed by the at least one lumiphoric material, and a portion of the light emissions of the at least one solid state light emitting source is reflected by the at least one reflective support surface toward the reflector.

3. The lighting device according to claim 2, wherein at least a portion of the at least one reflective support surface comprises a concave or convex shape.

4. The lighting device according to claim 1, wherein the at least one lumiphoric material, or a lumiphor support surface arranged to support the at least one lumiphoric material, is supported by the lens.

5. The lighting device according to claim 1, including a support structure that is distinct from the lens and is arranged to support the at least one lumiphoric material between the lens and the at least one aperture, wherein the support structure and the at least one lumiphoric material are spatially separated from and devoid of contact with the lens.

6. The lighting device of claim 5, wherein the support structure is supported between the lens and the reflector by a plurality of spokes extending inward from the reflector.

7. The lighting device according to claim 1, wherein the at least one solid state light emitting source comprises a first solid state light emitting source adapted to generate emissions including a first peak wavelength, and comprises a second solid state light emitting source adapted to generate emissions including a second peak wavelength, and wherein the first peak wavelength differs from the second peak wavelength by at least 30 nm.

8. The lighting device according to claim 7, comprising a beam combining element arranged to combine light emissions of the first solid state light emitting source and light emissions of the second solid state light emitting source into a single beam directed to the at least one lumiphoric material.

9. The lighting device according to claim 7, wherein the at least one aperture includes a first aperture arranged to enable transmission of light emissions of the first solid state light emitting source through the first aperture, and includes a second aperture arranged to enable transmission of light emissions of the second solid state light emitting source through the second aperture.

10. The lighting device according to claim 1, wherein the at least one lumiphoric material comprises a first lumiphoric material adapted to generate emissions including a third peak wavelength, and comprises a second lumiphoric material adapted to generate emissions including a fourth peak wavelength, and wherein the third peak wavelength differs from the fourth peak wavelength by at least 30 nm.

11. The lighting device according to claim 1, wherein the at least one lumiphoric material is arranged over at least one lumiphor support element, and the at least one lumiphoric material includes at least one of a pattern, composition, amount, and concentration that varies according to lateral position on the at least one lumiphor support element.

12. The lighting device according to claim 1, further comprising a mechanical or electromechanical element arranged to adjust position of the at least one lumiphoric material.

13. The lighting device according to claim 1, further comprising a mechanical or electromechanical element arranged to adjust at least one of (a) position, (b) aim, and (c) focus, of the at least one solid state light emitting source.

14. The lighting device according to claim 1, further comprising at least one sensor arranged to sense at least one of color, chromaticity, and intensity of lumiphor-converted light emissions, wherein the at least one solid state light emitting source is controllable responsive to at least one output signal of the at least one sensor.

15. The lighting device according to claim 1, including a heat sink arranged external to the lens, arranged in conductive thermal communication with the at least one lumiphoric material, and arranged to dissipate heat from the at least one lumiphoric material to an ambient air environment, wherein the heat sink includes a screw or movable element extending from a lumiphoric material support structure through the lens, and movement of the heat sink is arranged to cause movement of the at least one lumiphoric material.

16. A method comprising illuminating an object, a space, or an environment, utilizing the lighting device according to claim 1.

17. The lighting device according to claim 1, wherein the at least one solid state light emitting source comprises a laser arranged to emit a laser beam.

18. The lighting device of claim 1, further comprising a body portion arranged between the reflector and the base end, wherein the at least one solid state light emitting source is arranged in a recess of the body portion, a width of the reflector is greater than a width of the body portion, and a width of the recess is greater than a width of the at least one aperture.

19. A lighting device comprising:

a light-transmissive end;

at least one solid state light emitting source that comprises a first solid state light emitting source adapted to generate emissions including a first peak wavelength and comprises a second solid state light emitting source adapted to generate emissions including a second peak wavelength;

a reflector comprising a cup-shaped body defining a cavity, including a reflective surface, and including a light-transmissive opening arranged to permit transmission of light reflected by the reflector toward the light-transmissive end; and at least one lumiphoric material that is (i) spatially segregated from the at least one solid state light emitting source, (ii) arranged on or over at least one reflective support surface, (iii) arranged to receive at least a portion of light emissions of the at least one solid state light emitting source, and (iv) arranged to emit lumiphor-converted light emissions toward the reflector;

wherein the reflector is arranged to reflect lumiphor-converted light emissions toward the light-transmissive end; and wherein the at least one lumiphoric material comprises a first lumiphoric material and a second lumiphoric material, the at least one reflective support surface comprises a first convex reflective support surface and a second convex reflective support surface, the first lumiphoric material is arranged on or over the first convex reflective support surface to receive emissions from the first solid state light emitting source, the second lumiphoric material is arranged on or over the second convex reflective support surface to simultaneously receive emissions from the second solid state light emitting source, and aggregate emissions of the lighting device include emissions of the first lumiphoric material and the second lumiphoric material.

20. The lighting device according to claim 19, wherein the reflector includes a first aperture and a second aperture wherein the first aperture is arranged to enable transmission of light emissions of the first solid state light emitting source through the first aperture to impinge on the first lumiphoric material arranged on the first convex reflective support surface, and the second aperture is arranged to enable transmission of light emissions of the second solid state light emitting source through the second aperture to impinge on the second lumiphoric material arranged on the second convex reflective support surface.

21. The lighting device according to claim 19, wherein the first lumiphoric material is adapted to generate emissions including a third peak wavelength and the second lumiphoric material is adapted to generate emissions including a fourth peak wavelength, wherein the third peak wavelength differs from the fourth peak wavelength by at least 30 nm.

22. The lighting device according to claim 21, wherein:

the first peak wavelength differs from the second peak wavelength by at least 30 nm.

23. The lighting device according to claim 19, wherein at least one of the first lumiphoric material and the second lumiphoric material includes at least one of a pattern, composition, amount, and concentration that varies according to lateral position on at least one of the first convex reflective support surface and the second convex reflective support surface.

24. The lighting device according to claim 19, further comprising a mechanical or electromechanical element arranged to adjust position of the at least one lumiphoric material.

25. The lighting device according to claim 19, further comprising a mechanical or electromechanical element arranged to adjust at least one of (a) position, (b) aim, and (c) focus, of the at least one solid state light emitting source.

26. The lighting device according to claim 19, further comprising a heat sink in conductive thermal communication with the at least one lumiphoric material and arranged to dissipate heat from the at least one lumiphoric material to an ambient air environment.

27. The lighting device according to claim 19, further comprising at least one sensor arranged to sense at least one of color, chromaticity, and intensity of lumiphor-converted light emissions, wherein the at least one solid state light emitting source is controllable responsive to at least one output signal of the at least one sensor.

28. A method comprising illuminating an object, a space, or an environment, utilizing the lighting device according to claim 19.

29. The lighting device according to claim 19, wherein the at least one solid state light emitting source comprises a laser arranged to emit a laser beam, and the laser beam is arranged to traverse at least a portion of the cavity before impinging on the at least one lumiphoric material.

30. A lighting device comprising:

a light-transmissive end;

at least one solid state light emitting source;

a reflector comprising a cup-shaped body including a reflective surface and a light-transmissive opening arranged to permit transmission of light reflected by the reflector toward the light-transmissive end;

at least one lumiphoric material that is (i) spatially segregated from the at least one solid state light emitting source, (ii) arranged on or over at least one reflective lumiphor support surface, (iii) arranged to receive at least a portion of emissions of the at least one solid state light emitting source, and (iv) adapted to emit lumiphor-converted light emissions toward the reflector;

a lens proximate to the light-transmissive opening of the reflector; and a heat sink arranged external to the lens, arranged in conductive thermal communication with the at least one lumiphoric material, arranged to dissipate heat from the at least one lumiphoric material to an ambient air environment, and embodying a mechanical adjustment element enabling a user to adjust rotation of any of (a) the at least one reflective lumiphor support surface, and (b) the at least one lumiphoric material, in order to adjust at least one of chromaticity and color temperature of aggregated light emissions of the lighting device;

wherein the at least one lumiphoric material is arranged on or over the at least one reflective lumiphor support surface in an amount, concentration, or composition that varies with position; and wherein the reflector is arranged to reflect lumiphor-converted light emissions toward the light-transmissive end.

31. The lighting device according to claim 30, wherein at least a portion of the at least one reflective lumiphor support surface comprises a concave or convex shape.

32. The lighting device according to claim 30, further comprising a support structure distinct from the lens, wherein the support structure is arranged to support the at least one lumiphoric material between the lens and the at least one solid state light emitting source, and the lumiphoric material is spatially separated from the lens.

33. The lighting device according to claim 30, wherein the reflector comprises at least one aperture arranged to receive the at least one solid state light emitting source or arranged to enable transmission of light emissions of the at least one solid state light emitting source through the at least one aperture.

34. The lighting device according to claim 30, further comprising at least one sensor arranged to sense at least one of color, chromaticity, and intensity of lumiphor-converted light emissions, wherein the at least one solid state light emitting source is controllable responsive to at least one output signal of the at least one sensor.

35. A method comprising illuminating an object, a space, or an environment, utilizing the lighting device according to claim 30.

36. A method utilizing a lighting device according to claim 30, the method comprising:

operating the mechanical adjustment element to adjust interaction between the at least one solid state light emitting source and the at least one lumiphoric material to thereby adjust at least one of color and chromaticity of emissions transmitted by the lighting device through the light-transmissive end.

* * * * *